US011204035B2

(12) United States Patent
Jin et al.

(10) Patent No.: US 11,204,035 B2
(45) Date of Patent: Dec. 21, 2021

(54) SCROLL COMPRESSOR HAVING A VALVE ASSEMBLY CONTROLLING THE OPENING/CLOSING VALVE TO OPEN AND CLOSE COMMUNICATION PASSAGE AND BYPASS HOLES ON FIXED SCROLL

(71) Applicant: LG ELECTRONICS INC., Seoul (KR)

(72) Inventors: Honggyun Jin, Seoul (KR); Sangwoo Joo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 174 days.

(21) Appl. No.: 16/534,122

(22) Filed: Aug. 7, 2019

(65) Prior Publication Data

US 2019/0360489 A1 Nov. 28, 2019

Related U.S. Application Data

(62) Division of application No. 15/390,221, filed on Dec. 23, 2016, now Pat. No. 10,428,819.

(30) Foreign Application Priority Data

May 25, 2016 (KR) ..... 10-2016-0064343

(51) Int. Cl.
*F03C 2/00* (2006.01)
*F03C 4/00* (2006.01)
(Continued)

(52) U.S. Cl.
CPC ..... *F04C 28/26* (2013.01); *F04C 18/0215* (2013.01); *F04C 18/0261* (2013.01);
(Continued)

(58) Field of Classification Search
CPC ..... F04C 18/0215; F04C 18/0261; F04C 23/008; F04C 2240/30; F04C 28/16;
(Continued)

(56) References Cited

U.S. PATENT DOCUMENTS 5,613,841 A 3/1997 Bass et al.
6,412,293 B1 7/2002 Pham et al.
(Continued)

FOREIGN PATENT DOCUMENTS

CN 1272906 11/2000
CN 1348064 5/2002
(Continued)

OTHER PUBLICATIONS

U.S. Appl. No. 16/397,490, filed Apr. 29, 2019.
(Continued)

*Primary Examiner* — Theresa Trieu
(74) *Attorney, Agent, or Firm* — KED & Associates LLP

(57) ABSTRACT

A scroll compressor according to the present invention includes a casing, an orbiting member provided within the casing and performing an orbiting motion, a non-orbiting member forming a compression chamber together with the orbiting member, the compression chamber having a suction chamber, an intermediate pressure chamber and a discharge chamber, a communication passage configured to bypass a refrigerant of the compression chamber into the casing, an opening/closing valve assembly configured to open and close the communication passage, and a switching valve assembly configured to operate the opening/closing valve assembly, the switching valve assembly being provided outside the casing and connected to the opening/closing valve assembly, whereby an installation of the bypass hole can result in prevention of over-compression and an instal-
(Continued)

lation of a control valve for varying a capacity outside the casing can result in reduction of costs for the control valve.

18 Claims, 16 Drawing Sheets

(51) Int. Cl.

| | |
|---|---|
| ***F04C 18/00*** | (2006.01) |
| ***F04C 2/00*** | (2006.01) |
| ***F04C 28/26*** | (2006.01) |
| ***F04C 18/02*** | (2006.01) |
| ***F04C 23/00*** | (2006.01) |
| ***F04C 28/16*** | (2006.01) |
| ***F04C 28/24*** | (2006.01) |
| ***F04C 28/18*** | (2006.01) |
| ***F04C 29/00*** | (2006.01) |
| ***F04C 29/12*** | (2006.01) |

(52) U.S. Cl.
CPC ..... *F04C 23/008* (2013.01); *F04C 28/16* (2013.01); *F04C 28/18* (2013.01); *F04C 28/24* (2013.01); *F04C 29/0085* (2013.01); *F04C 29/124* (2013.01); *F04C 2240/30* (2013.01)

(58) Field of Classification Search
CPC ..... F04C 28/18; F04C 28/24; F04C 28/26; F04C 29/0085; F04C 29/124
See application file for complete search history.

(56) References Cited

U.S. PATENT DOCUMENTS

| | | | | |
|---|---|---|---|---|
| 7,674,098 | B2 | 3/2010 | Lifson | |
| 8,156,751 | B2 | 4/2012 | Jayanth | |
| 9,920,759 | B2 | 3/2018 | Sung et al. | |
| 10,316,843 | B2 | 6/2019 | Jin et al. | |
| 10,428,818 | B2 | 10/2019 | Jin et al. | |
| 10,428,819 | B2 | 10/2019 | Jin et al. | |
| 10,865,790 | B2 * | 12/2020 | Joo | F04C 18/0215 |
| 10,865,791 | B2 | 12/2020 | Kim et al. | |
| 2004/0042911 | A1 | 3/2004 | Hong et al. | |
| 2007/0183915 | A1 | 8/2007 | Guo et al. | |
| 2009/0110570 | A1 | 4/2009 | Cho | |
| 2009/0297377 | A1 * | 12/2009 | Stover | F04C 18/0215 418/55.5 |
| 2009/0297379 | A1 * | 12/2009 | Stover | F04C 18/0215 418/55.5 |
| 2010/0028182 | A1 | 2/2010 | Hahn | |
| 2010/0300659 | A1 | 12/2010 | Stover et al. | |
| 2010/0303659 | A1 | 12/2010 | Stover et al. | |
| 2011/0058972 | A1 | 3/2011 | Patel | |
| 2014/0154121 | A1 | 6/2014 | Doepker | |
| 2015/0192121 | A1 | 7/2015 | Sung et al. | |
| 2015/0345493 | A1 | 12/2015 | Lochner et al. | |
| 2016/0025093 | A1 | 1/2016 | Doepker | |
| 2019/0360489 | A1 | 11/2019 | Jin et al. | |

FOREIGN PATENT DOCUMENTS

| | | |
|---|---|---|
| CN | 1479014 | 3/2004 |
| CN | 101424265 | 5/2009 |
| CN | 101514701 | 8/2009 |
| CN | 102422024 | 4/2012 |
| CN | 102449314 | 5/2012 |
| CN | 202707487 | 1/2013 |
| EP | 0 144 169 | 6/1985 |
| EP | 1 004 773 | 5/2000 |
| EP | 1 197 661 | 4/2002 |
| EP | 2 093 427 | 8/2009 |
| JP | S59-203893 | 11/1984 |
| JP | H 01-106990 | 4/1989 |
| JP | H 05-340363 | 12/1993 |
| JP | H 08-303361 | 11/1996 |
| JP | 2003-083269 | 3/2003 |
| KR | 10-0308289 | 8/2001 |
| KR | 10-0360861 | 10/2002 |
| KR | 10-2004-0091361 | 10/2004 |
| KR | 10-0469461 | 2/2005 |
| KR | 10-1056882 | 8/2011 |
| KR | 10-2012-0008045 | 1/2012 |
| KR | 10-2014-0114740 | 9/2014 |
| KR | 10-2015-0126228 | 11/2015 |
| WO | WO 2009/155109 | 12/2009 |

OTHER PUBLICATIONS

Korean Office Action issued in Application 10-2016-0022081 dated Mar. 24, 2017.
Korean Notice of Allowance dated May 30, 2017 issued in Application No. 10-2016-0022081.
European Search Report dated Jun. 27, 2017 issued in Application No. 17154150.1.
Korean Office Action dated Aug. 11, 2017 issued in Application No. 10-2016-0066713.
Korean Office Action dated Aug. 14, 2017 issued in Application No. 10-2016-0064343.
European Search Report dated Sep. 19, 2017 issued in Application No. 17154222.8.
European Search Report dated Oct. 5, 2017 issued in Application No. 17154229.3.
Korean Notice of Allowance dated Feb. 14, 2018 issued in Application No. 10-2016-0066713.
Chinese Office Action dated Jun. 5, 2018 issued in Application No. 201710104227.4 (with English Translation).
Chinese Office Action dated Jul. 27, 2018 issued in Application No. 201710191912.5 (with English Translation).
United States Office Action dated Aug. 13, 2018 issued in related U.S. Appl. No. 15/388,584.
U.S. Office Action dated Sep. 26, 2018 issued in related U.S. Appl. No. 15/390,246.
U.S. Office Action dated Sep. 25, 2018 issued in parent U.S. Appl. No. 15/390,221.
Chinese Office Action dated Sep. 25, 2018 issued in Application No. 201710191859.9 (with English Translation).
United States Office Action dated Jan. 21, 2021 issued in co-pending related U.S. Appl. No. 16/397,490.

* cited by examiner

SCROLL COMPRESSOR HAVING A VALVE ASSEMBLY CONTROLLING THE OPENING/CLOSING VALVE TO OPEN AND CLOSE COMMUNICATION PASSAGE AND BYPASS HOLES ON FIXED SCROLL

CROSS-REFERENCE TO RELATED APPLICATIONS

This application is a Divisional Application of U.S. patent application Ser. No. 15/390,221 filed Dec. 23, 2016, which claims priority under 35 U.S.C. § 119 to Korean Application No. 10-2016-0064343 filed on May 25, 2016, whose entire disclosures are hereby incorporated by reference.

BACKGROUND

1. Field

This specification relates to a scroll compressor, and more particularly, a capacity varying apparatus for a scroll compressor.

2. Background

A scroll compressor is a compressor which is provided with a non-orbiting scroll provided in an inner space of a casing, and an orbiting scroll engaged with the non-orbiting scroll to perform an orbiting motion so as to form a pair of compression chambers, each of which includes a suction chamber, an intermediate pressure chamber and a discharge chamber, between a non-orbiting wrap of the non-orbiting scroll and an orbiting wrap of the orbiting scroll.

Compared with other types of compressors, the scroll compressor is widely used for refrigerant compression in an air-conditioning apparatus and the like, by virtue of advantages of obtaining a relatively high compression ratio and stable torques resulting from smoothly-performed suction, compression and discharge strokes of a refrigerant.

Scroll compressors may be classified into a high pressure type and a low pressure type according to a type of supplying a refrigerant into a compression chamber. The high pressure type compressor employs a method in which a refrigerant is introduced directly into a suction chamber without passing through an inner space of a casing and then discharged via the inner space of the casing. In this type compressor, most of the inner space of the casing form a high pressure portion as a discharge space. On the other hand, the low pressure type scroll compressor employs a method in which a refrigerant is introduced indirectly into the suction chamber via the inner space of the casing. In this type compressor, the inner space of the casing is divided into a low pressure portion as a suction chamber and a high pressure portion as a discharge space by a high/low pressure dividing plate.

FIG. 1 is a longitudinal sectional view of a low pressure type scroll compressor according to the related art.

As illustrated in FIG. 1, the low pressure type scroll compressor according to the related art includes a driving motor 20 disposed in an inner space 11 of a hermetic casing 10 to generate a rotation force, and a main frame 30 disposed at an upper side of the driving motor 20.

The orbiting wrap 40 is disposed on an upper surface of the main frame 30 to be orbited by an Oldham-ring (not illustrated), and the non-orbiting scroll 50 is provided on an upper side of the orbiting scroll 40 to be engaged with the orbiting scroll 40 and thus form compression chambers P.

A rotation shaft 25 is coupled to a rotor 22 of the driving motor 20, the orbiting scroll 40 is eccentrically coupled to the rotation shaft 25, and the non-orbiting scroll 50 is coupled to the main frame 30 in a manner of being restricted from being orbited.

A back pressure chamber assembly 60 for preventing the non-orbiting scroll 50 from being raised up due to pressure of the compression chamber P during an operation is coupled to an upper side of the non-orbiting scroll 50. The back pressure chamber assembly 60 is provided with a back pressure chamber 60*a* in which a refrigerant of intermediate pressure is filled.

A high/low pressure dividing plate 15 is provided on an upper side of the back pressure chamber assembly 60. The high/low pressure dividing plate 15 supports a rear surface of the back pressure chamber assembly 60 and simultaneously divides the inner space 11 of the casing 10 into a low pressure portion 11 as a suction space and a high pressure portion 12 as a discharge space.

The high/low pressure dividing plate 15 has an outer circumferential surface attached to an inner circumferential surface of the casing 10 in a welding manner, and is provided with a discharge hole 15*a* formed through a central portion thereof to communicate with a discharge port 54 of the non-orbiting scroll 50.

In the drawing, a non-explained reference numeral 13 denotes a suction pipe, 14 denotes a discharge pipe, 18 denotes a sub frame, 21 denotes a stator, 21*a* denotes a winding coil, 41 denotes a disk portion of the orbiting scroll, 42 denotes the orbiting wrap, 51 denotes a disk portion of the non-orbiting scroll, 52 denotes the non-orbiting wrap, 53 denotes a suction port, and 61 denotes a modulation ring for varying a capacity.

With the configuration of the related art scroll compressor, when a rotation force is generated in the driving motor 20 in response to power supplied to the driving motor 20, the rotation shaft 25 transfers the rotation force of the driving motor 20 to the orbiting scroll 40.

The orbiting scroll 40 then performs an orbiting motion with respect to the non-orbiting scroll 50 by the Oldham-ring. Accordingly, a pair of compression chambers P is formed between the orbiting scroll 40 and the non-orbiting scroll 50 such that a refrigerant can be sucked, compressed and discharged.

In this instance, the refrigerant compressed in the compression chambers P is partially introduced from the intermediate pressure chamber into the back pressure chamber 60*a* through a back pressure hole (not illustrated). The refrigerant of intermediate pressure introduced into the back pressure chamber 60*a* generates back pressure to lift a floating plate 65 constructing the back pressure chamber assembly 60. The floating plate 65 is closely adhered on a lower surface of the high/low pressure dividing plate 15 such that the high pressure portion 12 and the low pressure portion 11 are divided from each other. Simultaneously, pressure of the back pressure chamber pushes the non-orbiting scroll 50 toward the orbiting scroll 40, to maintain the compression chamber P between the non-orbiting scroll 50 and the orbiting scroll 40 in an air-tight state.

Here, the scroll compressor, similar to other types of compressors, may vary a compression capacity according to requirement of a refrigerating device with the compressor. For example, as illustrated in FIG. 1, the modulation ring 61 and a lift ring 62 are additionally provided on the disk portion 51 of the non-orbiting scroll 50, and a control valve 63 which communicates with the back pressure chamber 60*a* through a first communication passage 61*a* is provided on one side of the modulation ring 61. A second communication passage 61*b* is formed between the modulation ring 61 and the lift ring 62, and a third communication passage 61*c* which is open when the modulation ring 61 rises is formed between the modulation ring 61 and the non-orbiting scroll 50. One end of the third communication passage 61*c* communicates with the intermediate compression chamber P and another end thereof communicates with the low pressure portion 11 of the casing 10.

During a power operation (mode) of the scroll compressor, as illustrated in FIG. 2A, the control valve 63 closes the first communication passage 61*a* and opens the second communication passage 61*b* to communicate with the low pressure portion 11, thereby preventing the modulation ring 61 from being raised up. Accordingly, the third communication passage 61*c* is maintained in a closed state.

On the other hand, during a power-saving operation (mode) of the scroll compressor, as illustrated in FIG. 2B, the control valve 63 communicates the first communication passage 61*a* with the second communication passage 61*b*. Accordingly, the modulation ring 61 is raised up to open the third communication passage 61*c*, such that the refrigerant within the intermediate compression chamber P is partially leaked into the low pressure portion 11. This results in a reduction of a capacity of the compressor.

However, the capacity varying apparatus of the related art scroll compressor which includes the modulation ring 61, the lift ring 62 and the control valve 63 requires such a lot of components. Also, the first communication passage 61*a*, the second communication passage 61*b* and the third communication passage 61*c* should be formed on the modulation ring 61 to operate the modulation ring 61, which makes the structure of the modulation ring 61 complicated.

Furthermore, the capacity varying apparatus of the related art scroll compressor should fast lift the modulation ring 61 using the refrigerant of the back pressure chamber 60*a*. However, as the modulation ring 61 is formed in a ring shape and coupled with the control valve 63, a weight of the modulation ring 61 increases which makes it difficult to fast lift the modulation ring 61. In addition, a passage for lifting the modulation ring 61 is long and even the refrigerant should be introduced into a space between the modulation ring 61 and the lift ring 62 to lift the modulation ring 61, but the pressure of the back pressure chamber 60*a* still exists on the upper surface of the modulation ring 61. Therefore, the lifting of the modulation ring 61 is not easy and responsiveness of the valve is lowered, which results in interfering with a fast control of the variation of the capacity of the compressor.

In the capacity varying apparatus of the related art scroll compressor, a bypass hole and a control valve 63 for opening and closing the bypass hole are structurally unable to be employed. Accordingly, upon an occurrence of over-compression in a corresponding operation mode, the apparatus is unable to appropriately handle it, which results in lowering efficiency of the compressor.

In the capacity varying apparatus of the related art scroll compressor, as the control valve 63 is installed within the casing 10, a size of the control valve 63 should be decided by considering the inner space of the casing, which lowers a degree of freedom to design of the control valve 63. Furthermore, the control valve 63 in a small size should be used due to a limited space. This causes an increase in fabricating costs which results from restrictions on the use of standardized cheap components.

In the capacity varying apparatus of the related art scroll compressor, a separate terminal for supplying power to the control valve should further be provided in addition to a terminal for supplying power to the driving motor. This results in an increase in the number of components, which causes an increase in the number of assembly processes, and thereby causes an increase in fabricating costs.

BRIEF DESCRIPTION OF THE DRAWINGS

Embodiments will be described in detail with reference to the following drawings in which like reference numerals refer to like elements, and wherein:

FIGS. 10A and 10B are schematic views illustrating operations of a first valve assembly and a second valve assembly according to an operating mode of the compressor of FIG. 3, wherein FIG. 10A illustrates a power mode and FIG. 10B illustrates a saving mode;

FIGS. 15A and 15B are schematic views illustrating operations of a check valve and a valve assembly according to an operating mode of the compressor in FIG. 13, wherein FIG. 15A illustrates a power mode, and FIG. 15B illustrates a saving mode.

DETAILED DESCRIPTION

Description will now be given in detail of a scroll compressor according to exemplary embodiments disclosed herein, with reference to the accompanying drawings.

Figure 1:
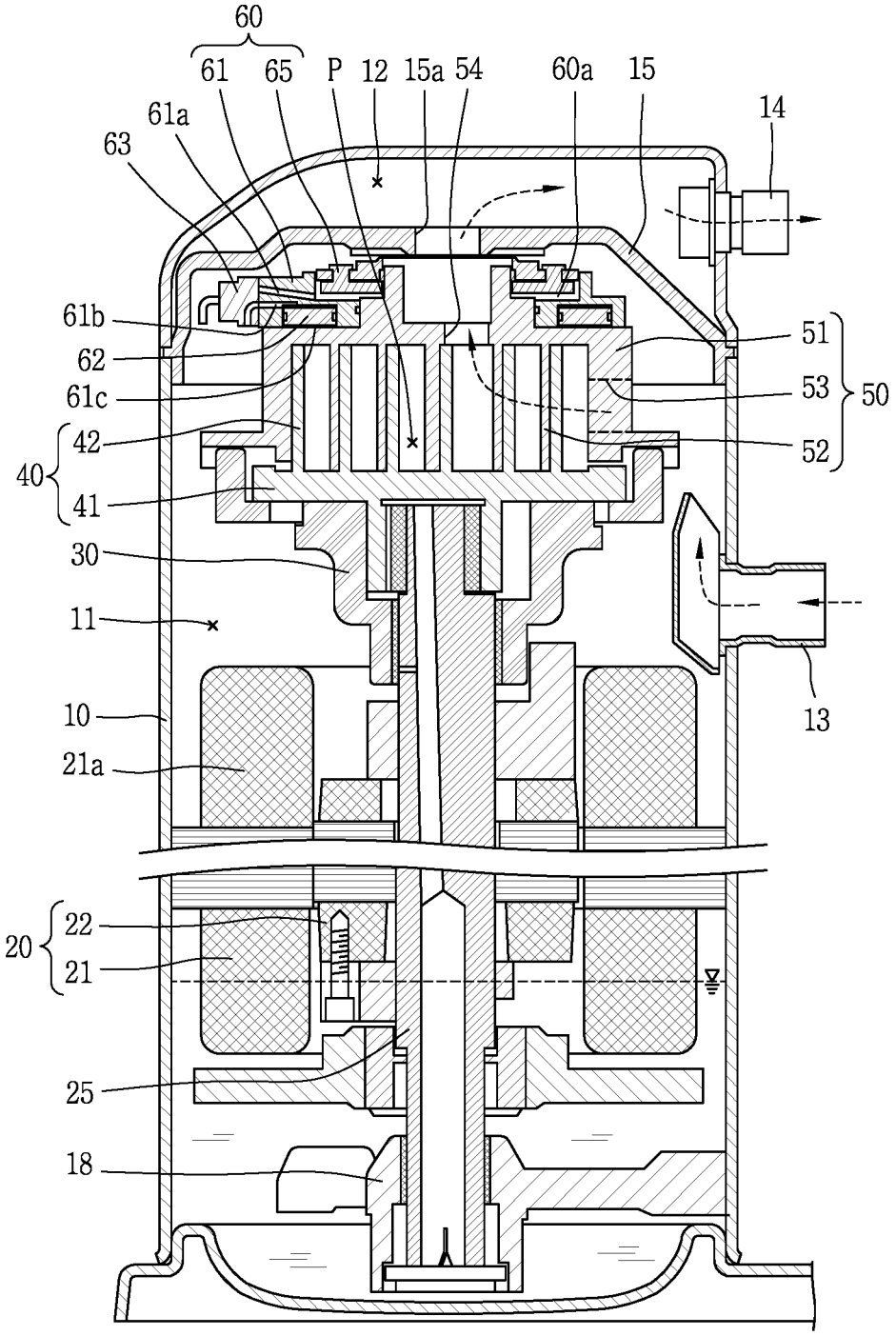
FIG. 1 RELATED ART
FIG. 1 is a longitudinal sectional view of a scroll compressor having a capacity varying apparatus according to the related art.
Figure 2A:
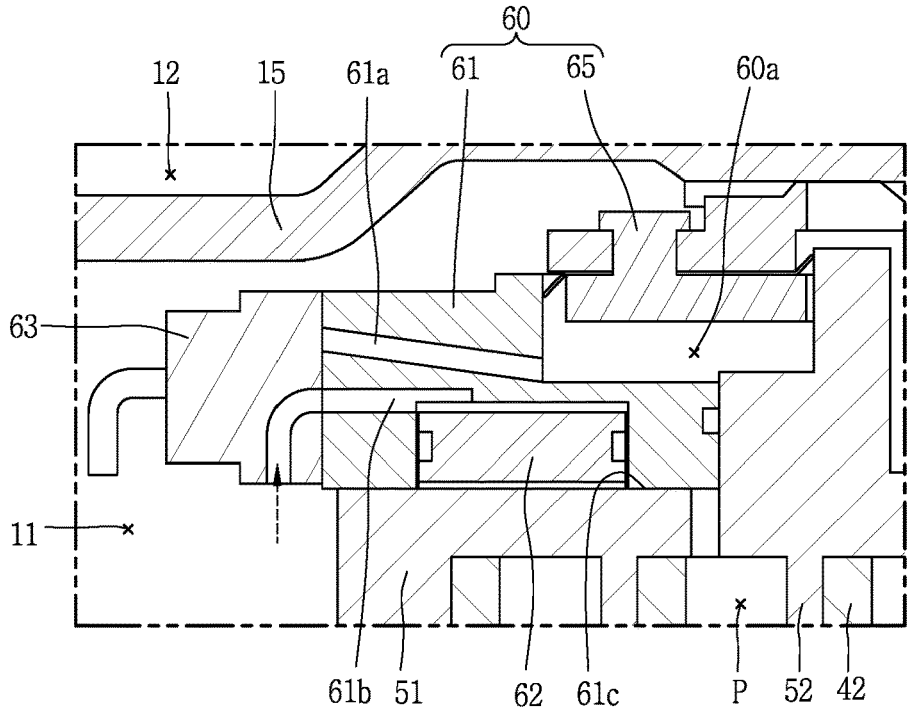
FIG. 2A RELATED ART
FIGS. 2A and 2B are longitudinal sectional views illustrating a power-operation state and a saving-operation state using the capacity varying apparatus in the scroll compressor of FIG. 1.
Figure 2B:
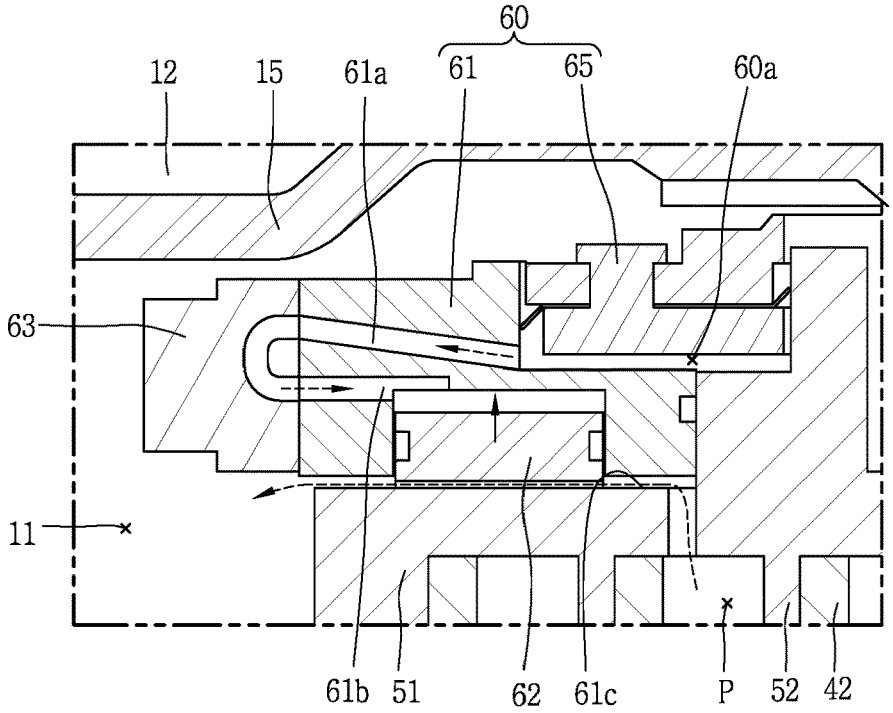
FIG. 2B RELATED ART
Figure 3:
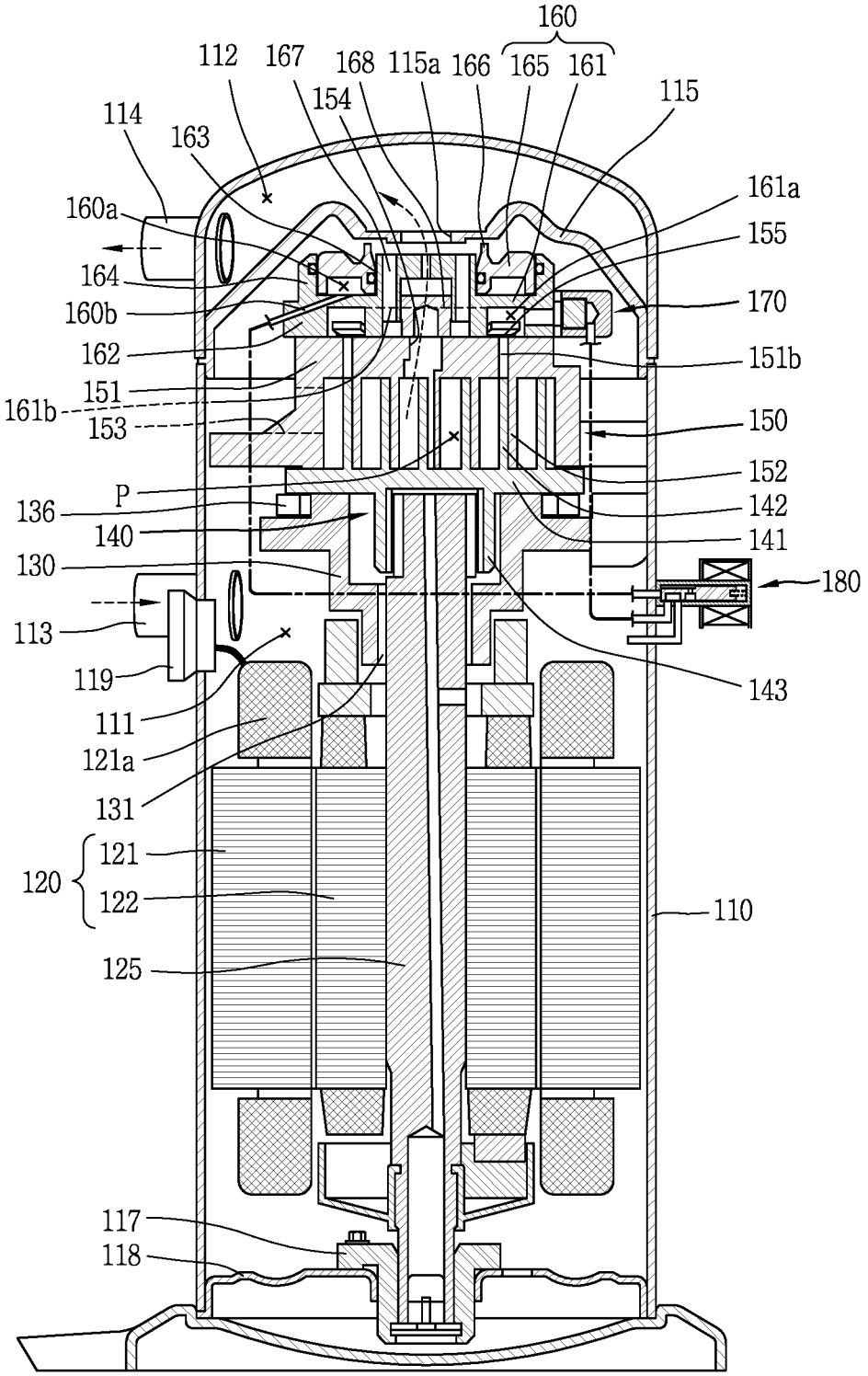
FIG. 3 is a longitudinal sectional view illustrating a scroll compressor having a capacity varying apparatus in accordance with the present invention.
Figure 4:
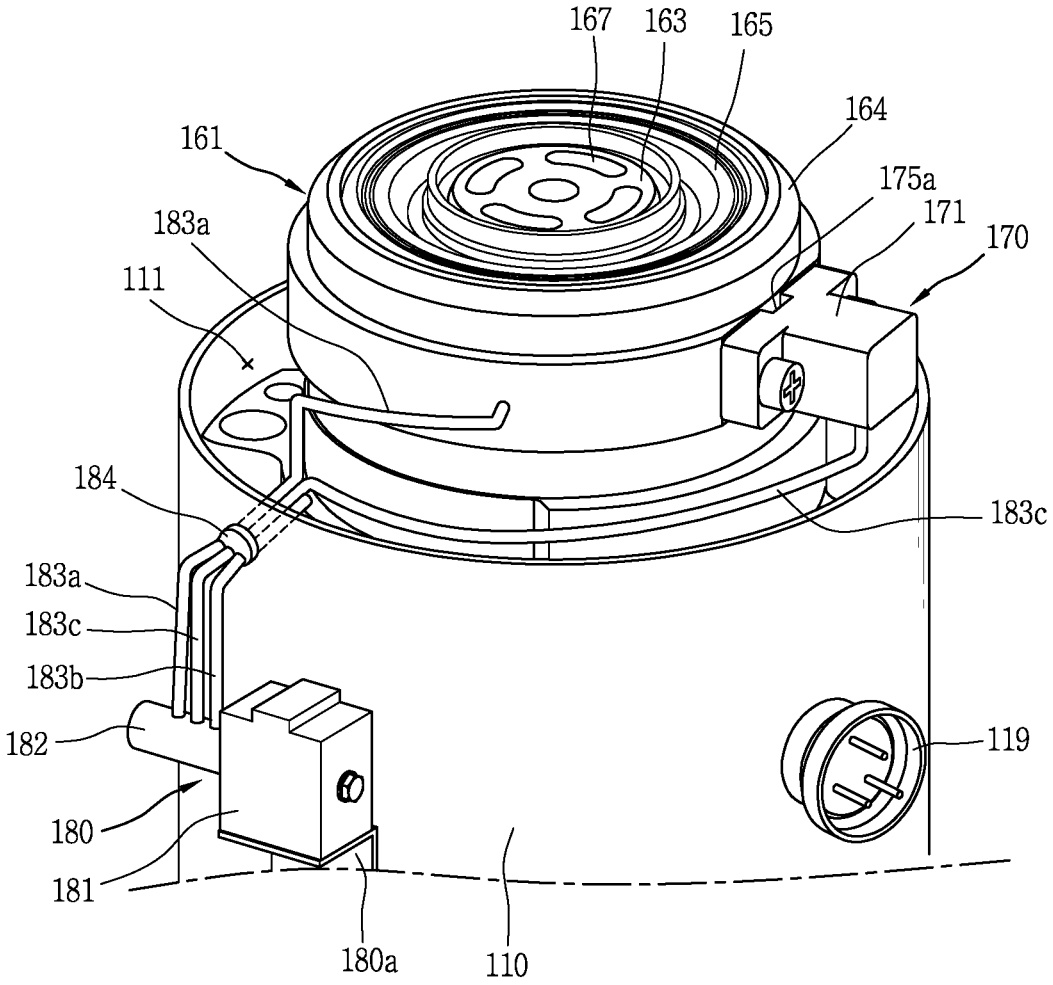
FIG. 4 is a perspective view illustrating an inside of the scroll compressor having the capacity varying apparatus according to FIG. 3.
Figure 5:
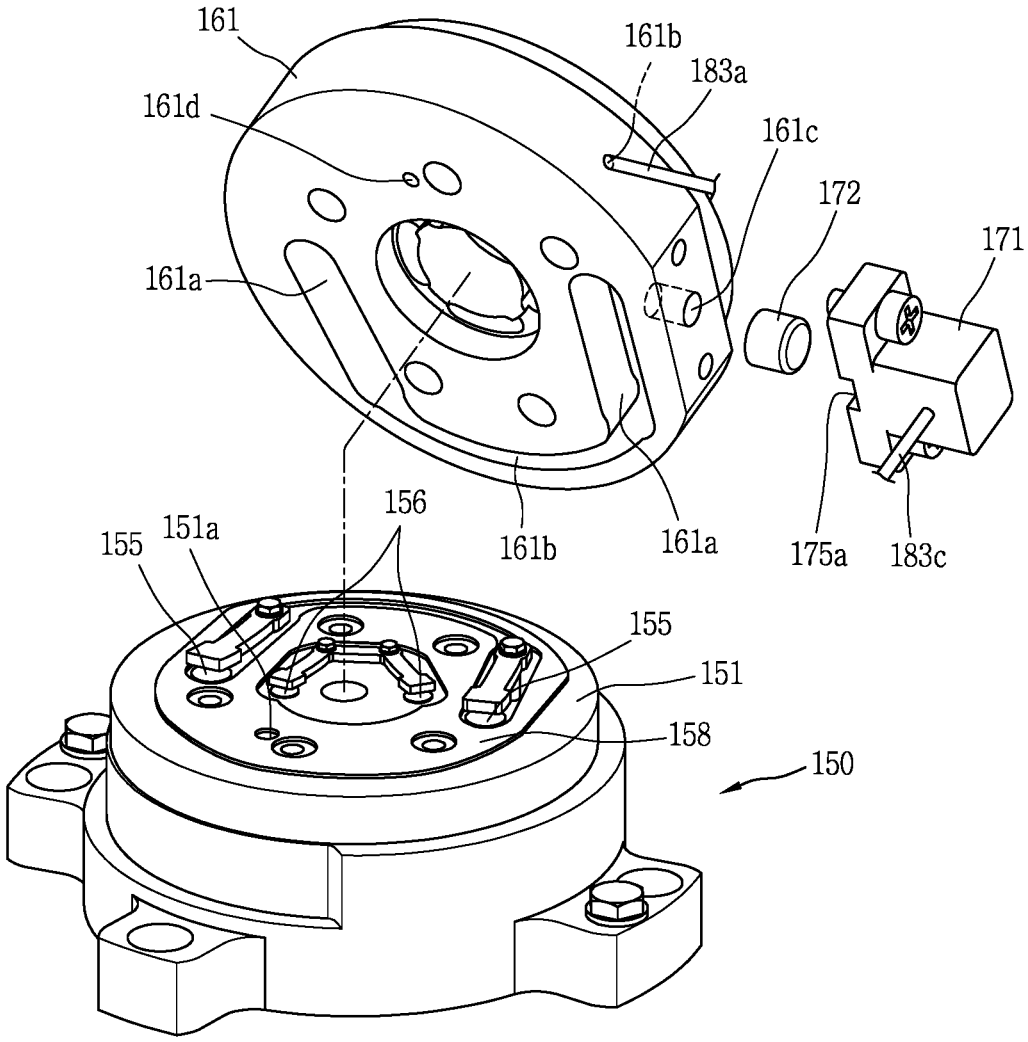
FIG. 5 is an exploded perspective view of the capacity varying apparatus of FIG. 3.

FIG. 3 is a longitudinal sectional view illustrating a scroll compressor having a capacity varying apparatus in accordance with the present invention, FIG. 4 is a perspective view illustrating an inside of the scroll compressor having the capacity varying apparatus according to FIG. 3, and FIG. 5 is an exploded perspective view of the capacity varying apparatus of FIG. 3.

As illustrated in FIG. 3, a scroll compressor according to this embodiment is configured such that a hermetic inner space of a casing 110 is divided into a low pressure portion 111 as a suction space and a high pressure portion 112 as a discharge space by a high/low pressure dividing plate 115, which is provided on an upper side of a non-orbiting scroll 150 to be explained later. Here, the low pressure portion 111 corresponds to a lower space of the high/low pressure dividing plate 115, and the high pressure portion 112 corresponds to an upper space of the high/low pressure dividing plate 115.

A suction pipe 113 communicating with the low pressure portion 111 and a discharge pipe 114 communicating with the high pressure portion 112 are fixed to the casing 110, respectively, such that a refrigerant can be sucked into the inner space of the casing 110 or discharged out of the casing 110.

The low pressure portion 111 of the casing 110 is provided with a driving motor 120 having a stator 121 and a rotor 122. The stator 121 is fixed to an inner wall surface of the casing 100 in a shrink-fitting manner, and a rotation shaft 125 is inserted into a central portion of the rotor 122. A coil 121*a* is wound on the stator 121. The coil 121*a*, as illustrated in FIGS. 3 and 4, is electrically connected to an external power supply source through a terminal 119, which is coupled through the casing 110.

A lower side of the rotation shaft 125 is rotatably supported by an auxiliary bearing 117 provided on a lower portion of the casing 110. The auxiliary bearing 117 is supported by a lower frame 118 fixed to an inner surface of the casing 110 and thus can stably support the rotation shaft 125. The lower frame 118 may be welded on an inner wall surface of the casing 110. A bottom surface of the casing 110 is used as an oil storage space. Oil stored in the oil storage space is carried upwardly by the rotation shaft 125 and the like and thus introduced into a driving unit and the compression chamber for facilitating lubrication.

An upper end portion of the rotation shaft 125 is rotatably supported by a main frame 130. The main frame 130, similar to the lower frame 118, is fixed to the inner wall surface of the casing 110. A main bearing portion 131 downwardly protrudes from a lower surface of the main frame 130, and the rotation shaft 125 is inserted into the main bearing portion 131. An inner wall surface of the main bearing portion 131 serves as a bearing surface, and supports the rotation shaft together with the oil, such that the rotation shaft 125 can smoothly rotate.

An orbiting scroll 140 is disposed on an upper surface of the main frame 130. The orbiting scroll 140 includes a disk portion 141 having a shape similar to a disk, and an orbiting wrap 142 spirally formed on one side surface of the disk portion 141. The orbiting wrap 142 forms the compression chambers P together with a non-orbiting wrap 152 of the non-orbiting scroll 150 to be explained later.

The disk portion 141 of the orbiting scroll 140 orbits in a state of being supported by the upper surface of the main frame 130. An Oldham-ring 136 is interposed between the disk portion 141 and the main frame 130 to prevent self-rotation of the orbiting scroll 140.

A boss 143 in which the rotation shaft 125 is inserted is formed on a lower surface of the disk portion 141 of the orbiting scroll 140, and accordingly the orbiting scroll 140 is orbited by the rotational force of the rotation shaft 125.

The non-orbiting scroll 150 engaged with the orbiting scroll 140 are disposed on the orbiting scroll 140. Here, the non-orbiting scroll 150 is provided to be movable up and down with respect to the orbiting scroll 140. In detail, the non-orbiting scroll 150 is supported with being laid on an upper surface of the main frame 130 in a manner that a plurality of guide pins (not illustrated) inserted into the main frame 130 are inserted in a plurality of guide holes (not illustrated) formed on an outer circumferential portion of the non-orbiting scroll 150.

Meanwhile, the non-orbiting scroll 150 includes a disk portion 151 formed in a disk shape on an upper surface of a body thereof, and the non-orbiting wrap 152 spirally formed on a lower portion of the disk portion 151 and engaged with the orbiting wrap 142 of the orbiting scroll 140.

A suction port 153 through which a refrigerant existing in the low pressure portion 111 is sucked is formed through a side surface of the non-orbiting scroll 150, and a discharge port 154 through which a compressed refrigerant is discharged is formed through an approximately central portion of the disk portion 151.

As aforementioned, the orbiting wrap 142 and the non-orbiting wrap 152 form a plurality of compression chambers P. The compression chambers are reduced in volume while orbiting toward the discharge port 154, thereby compressing the refrigerant. Therefore, the lowest pressure is existing in a compression chamber adjacent to the suction port 153, the highest pressure is existing in a compression chamber communicating with the discharge port 154, and pressure of a compression chamber present therebetween is intermediate pressure which has a value between suction pressure of the suction port 153 and discharge pressure of the discharge port 154. The intermediate pressure is applied to a back pressure chamber 160*a* to be explained later and serves to press the non-orbiting scroll 150 toward the orbiting scroll 140. Accordingly, a scroll-side back pressure hole 151*a*, which communicates with one of areas having the intermediate pressure and through which the refrigerant is discharged, is formed on the disk portion 151, as illustrated in FIG. 5.

A back pressure plate 161 which forms a part of the back pressure chamber assembly 160 is fixed to a top of the disk portion 151 of the non-orbiting scroll 150. The back pressure plate 161 is formed approximately in an annular shape, and provided with a supporting plate 162 which is brought into contact with the disk portion 151 of the non-orbiting scroll 150. The supporting plate 162 has a shape of an annular plate with a hollow center. Also, as illustrated in FIG. 5, a plate-side back pressure hole 161*d* communicating with the scroll-side back pressure hole 151*a* is formed through the supporting plate 162.

First and second annular walls 163 and 164 are formed on an upper surface of the supporting plate 162 along an inner circumferential portion and an outer circumferential portion of the supporting plate 162. An outer circumferential surface of the first annular wall 163, an inner circumferential surface of the second annular wall 164 and the upper surface of the supporting plate 162 form the back pressure chamber 160*a* formed in the annular shape.

A floating plate 165 forming an upper surface of the back pressure chamber 160*a* is provided on an upper side of the back pressure chamber 160*a*. A sealing end portion 166 is disposed on an upper end portion of an inner space of the floating plate 165. In detail, the sealing end portion 166 upwardly protrudes from a surface of the floating plate 165, and has an inner diameter which is not so great to obscure an intermediate discharge port 167. The sealing end portion 166 comes in contact with a lower surface of the high/low pressure dividing plate 115, such that a discharged refrigerant can be discharged to the high pressure portion 112 without being leaked into the low pressure portion 111.

A non-explained reference numeral 156 denotes a bypass valve which opens and closes a discharge bypass hole for bypassing a part of a refrigerant compressed in an intermediate compression chamber to prevent over-compression, and 168 denotes a check valve which prevents a refrigerant discharged to the high pressure portion from flowing back into the compression chamber.

Hereinafter an operation of the scroll compressor according to the embodiment of the present invention will be described.

That is, when power is applied to the stator 121, the rotation shaft 125 rotates. The orbiting scroll 140 coupled to an upper end portion of the rotation shaft 125 performs an orbiting motion with respect to the non-orbiting scroll 150, in response to the rotation of the rotation shaft 125. Accordingly, a plurality of compression chambers P formed between the non-orbiting wrap 152 and the orbiting wrap 142 move toward the discharge port 154. During the movement, a refrigerant is compressed.

When the compression chamber P communicates with the scroll-side back pressure hole (not illustrated) before arriving at the discharge port 154, the refrigerant is partially introduced into the plate-side back pressure hole (not illustrated) formed through the supporting plate 162, which results in applying intermediate pressure to the back pressure chamber 160*a* that is formed by the back pressure plate 161 and the floating plate 165. Accordingly, the back pressure plate 161 is affected by pressure applied in a downward direction and the floating plate 165 is affected by pressure applied in an upward direction.

Here, since the back pressure plate 161 is coupled to the non-orbiting scroll 150 by a bolt, the intermediate pressure of the back pressure chamber 160*a* also affects the non-orbiting scroll 150. However, the non-orbiting scroll 150 is unable to be moved downward due to already being brought into contact with the disk portion 141 of the orbiting scroll 140, and thus the floating plate 165 is moved upward. The floating plate 165 prevents a leakage of the refrigerant from the discharge space as the high pressure portion 112 into the suction space as the low pressure portion 111, in response to the sealing end portion 166 thereof being brought into contact with a lower end portion of the high/low pressure dividing plate 115. In addition, the non-orbiting scroll 150 is pushed toward the orbiting scroll 140 by the pressure of the back pressure chamber 160*a*, thereby blocking the leakage of the refrigerant between the orbiting scroll 140 and the non-orbiting scroll 150.

When a capacity varying apparatus is applied to the scroll compressor according to this embodiment, capacity varying bypass holes (hereinafter, referred to as 'bypass holes') 151*b* that communicate with the intermediate pressure chamber are formed through the disk portion 151 of the non-orbiting scroll 150 in a direction from the intermediate pressure chamber toward a rear surface of the disk portion 151. The bypass holes 151*b* are formed with an interval of 180° with facing each other such that refrigerants with the same intermediate pressure in inner and outer pockets can be bypassed. However, when a wrap length of the orbiting wrap 142 is asymmetrically longer by 180° than a wrap length of the non-orbiting wrap 152, the same pressure is generated at the same crank angle in the inner pocket and the outer pocket. Therefore, the two bypass holes 151*b* may be formed at the same crank angle or only one bypass hole may be formed such that both of the inner and outer pockets communicate with each other.

A check valve 155 for opening and closing the bypass hole 151*b* is provided at an end portion of each of the bypass holes 151*b*. The check valve 155 may be configured as a reed valve which is opened and closed according to pressure of the intermediate pressure chamber.

Figure 7:
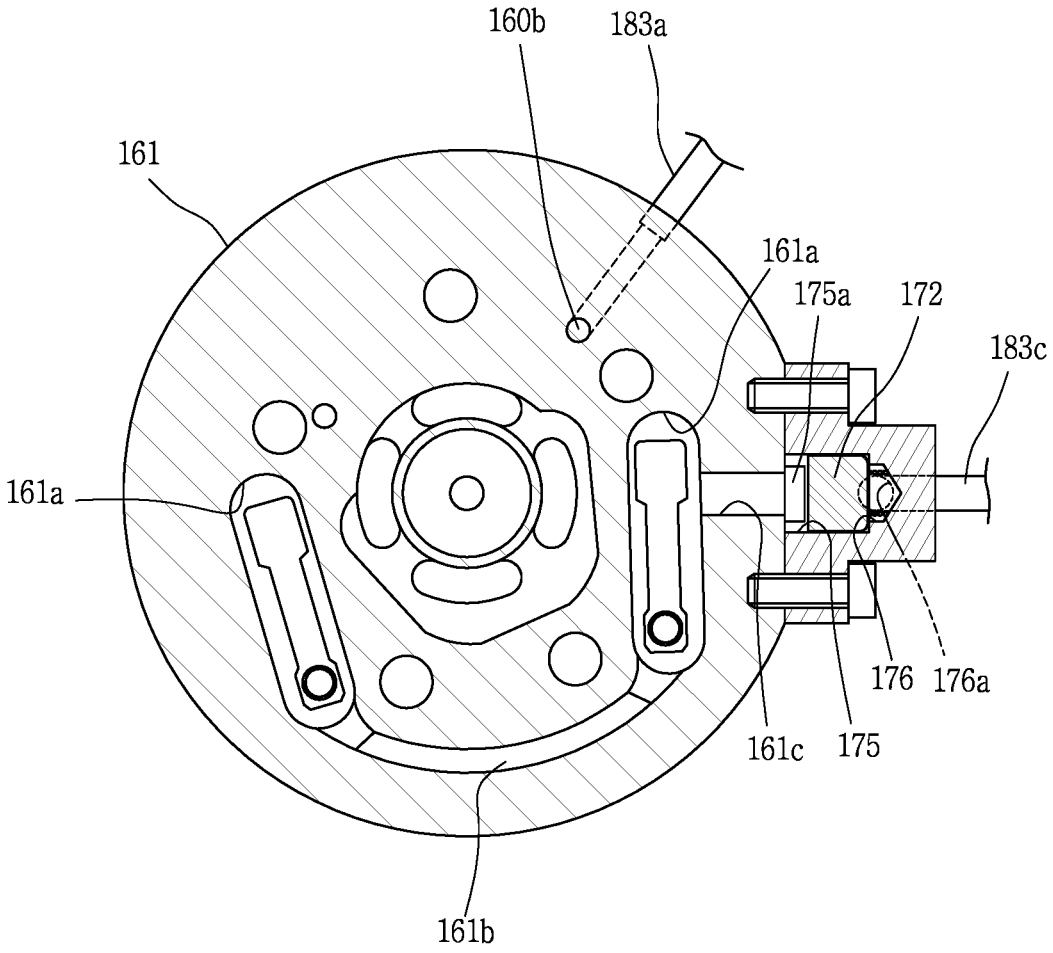
FIG. 7 is a horizontal sectional view of a back pressure plate in FIG. 3.

As illustrated in FIGS. 5 and 7, a plurality of valve accommodation grooves 161*a* in which the check valves 155 are accommodated, respectively, are formed on a lower surface of the back pressure plate 161 corresponding to the rear surface of the disk portion 151 of the non-orbiting scroll 150. The plurality of valve accommodation grooves 161*a* may communicate with each other through a communication groove 161*b*.

One end of a discharge hole 161*c* for guiding a bypassed refrigerant into the suction space as the low pressure portion 111 of the casing 110 is connected to one of the plurality of valve accommodation grooves 161*a* or the communication groove 161*b*. Another end of the discharge hole 161*c* penetrates through an outer circumferential surface of the back pressure plate 161. Accordingly, when the valve accommodation grooves 161*a*, the communication groove 161*b* and the discharge hole 161*c* form the intermediate pressure chamber P1, in which a refrigerant of intermediate pressure is stored, when the check valves 155 are open.

Meanwhile, as illustrated in FIGS. 3 to 7, a first valve assembly 170 is provided on an outer circumferential surface of the back pressure plate 161. The first valve assembly 170 communicates with an end portion of the discharge hole 161*c* and selectively opens and closes the discharge hole 161*c* according to an operating mode of the compressor.

The first valve assembly 170 is a type of check valve that opens and closes the discharge hole 161*c* while a piston valve 172 to be explained later moves according to a pressure difference between both sides thereof. The first valve assembly 170 includes a valve guide 171 having a valve space 175 and coupled to the back pressure plate 161, and a piston valve 172 slidably inserted into the valve guide 171 and opening and closing the discharge hole 161*c* while reciprocating in the valve space 175 according to the pressure difference.

The valve guide 171 includes therein the valve space 175 formed in a radial direction, and a differential pressure space 176 outwardly extending from the valve space 175 to apply operation pressure to a rear surface of the piston valve 172 that is inserted into the valve space 175.

Exhaust holes 175*a* are formed on both upper and lower sides of the valve space 175 in a manner of communicating with the discharge hole 161*c*. The exhaust holes 175*a* are open when the piston valve 172 is pushed backward, so as to guide a refrigerant discharged through the discharge hole 161*c* into the inner space of the casing 110 as the low pressure portion 111.

An injection hole 176*a* is formed on one side of the differential pressure space 176, and coupled with an end portion of a third connection pipe 183*c* such that the third connection pipe 183*c* communicates with the differential pressure space 176. Accordingly, a refrigerant of intermediate pressure or suction pressure guided along the third connection pipe 183*c* is selectively supplied into the differential pressure space 176 through the injection hole 176*a*.

Figure 6A:
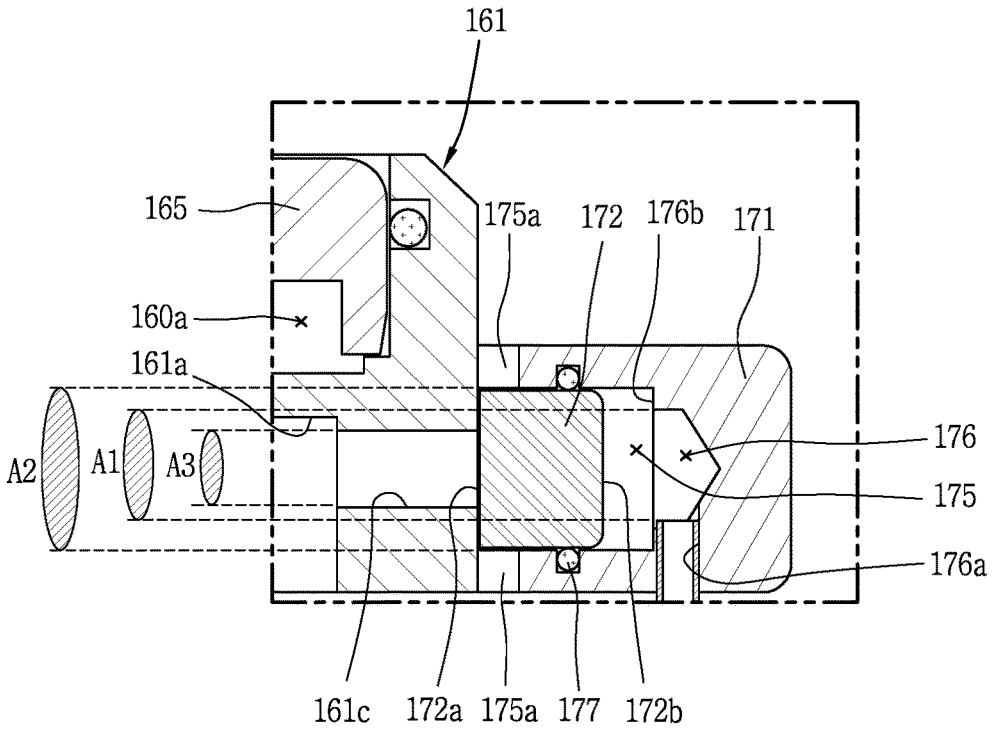
FIGS. 6A and 6B are enlarged longitudinal sectional views of embodiments related to a first valve assembly in the capacity varying apparatus of FIG. 3.

As illustrated in FIG. 6A, a sectional area A1 of the differential pressure space 176 in a radial direction thereof is smaller than a sectional area A2 of the valve space 175 in a radial direction thereof. A stepped surface 176*b* is formed between the differential pressure space 176 and the valve space 175. The stepped surface 176*b* supports a rear end of the piston valve 172 to limit a pushed amount of the piston valve 172. Therefore, the injection hole 176*a* is formed adjacent to the differential pressure space 176 on the basis of the stepped surface 176*b* between the valve space 175 and the differential pressure space 176.

The sectional area A1 of the differential pressure space 176 is greater than a sectional area A3 of the discharge hole 161*c* in a radial direction thereof. Accordingly, upon closing the piston valve 172, even though pressure of the discharge hole 161*c* and pressure of the differential pressure space 176 are the same as each other, an area that pressure is applied from the differential pressure space 176 to a rear surface (back pressure surface) 172*b* of the piston valve 172 is greater than an area that pressure is applied from the discharge hole 161*c* to a front surface (open/close surface) 172*a* of the piston valve 172. Consequently, the piston valve 172 can be maintained in a closed state.

The piston valve 172 is formed in a shape with a circular section, which has an outer diameter almost the same as an inner diameter of the valve space 175, so as to be slidable in the valve space 175. Since the piston valve 172 is moved according to a difference between the pressure of the back pressure space 176 and the pressure of the discharge hole 161*c*, each of the open/close surface 172*a* and the back pressure surface 172*b* of the piston valve 172 may be likely to collide with an outer side surface of the back pressure plate 161 or the stepped surface of the valve guide 171. Therefore, the piston valve 172 may preferably be formed of a material, which can minimize noise generated upon the collision with providing rigidity great enough to avoid damage due to the collision and is smoothly slidable, for example, a material such as engineer plastic.

Figure 6B:
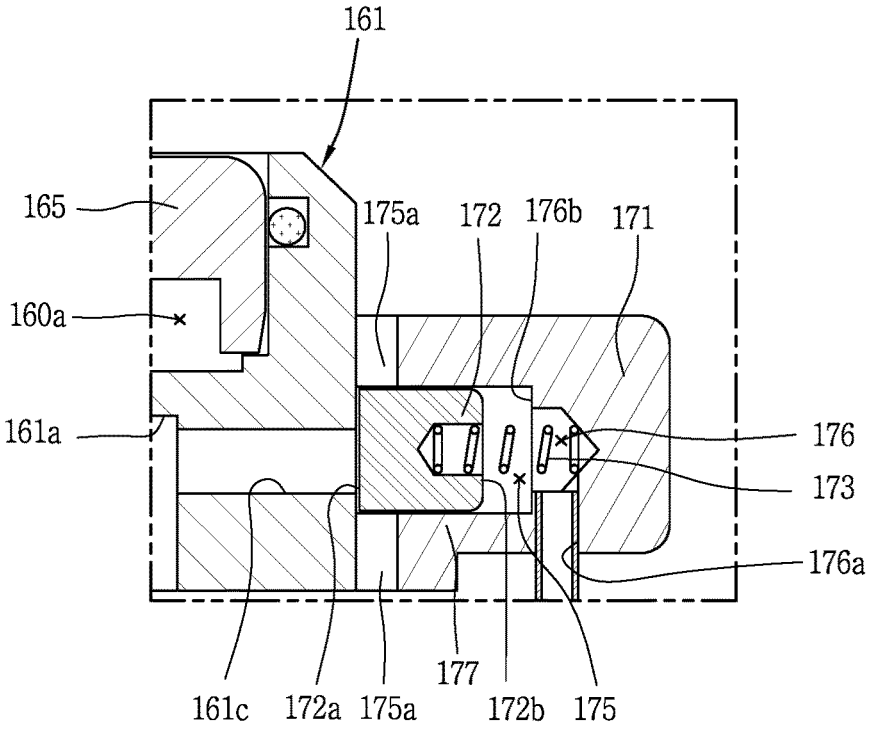

The piston valve 172, as illustrated in FIG. 6A, may also be configured to be movable only by the pressure difference between the open/close surface 172*a* and the back pressure surface 172*b*, but in some cases, as illustrated in FIG. 6B, may further be provided with a pressing spring 173, such as a compression coil spring, on the back pressure surface 172*b*. In case of providing the pressing spring 173, the pressing spring 173 may push the piston valve 172 toward the front so as to prevent vibration of the piston valve 172 due to a low pressure difference between both sides of the piston valve 172, when pressure applied to a pressure-applied surface is low due to intermediate pressure failing to reach sufficient pressure, similar to the moment of starting the compressor.

Also, instead of the pressing spring, an O-ring recess (no reference numeral given) may be provided on a sliding surface of the valve guide 171 which comes in contact with an outer surface of the piston valve 172, and an O-ring 177 may be inserted into the O-ring recess. This may result in preventing a leakage of a refrigerant due to differential pressure between the valve space 175 and the exhaust holes 175*a* and preventing the vibration of the piston valve 172 due to the pressure difference.

Meanwhile, as illustrated in FIGS. 3 to 9, the scroll compressor according to this embodiment includes a second valve assembly 180 for operating the first valve assembly 170. Accordingly, the second valve assembly 180 selectively applies intermediate pressure or suction pressure to the first valve assembly 170, such that the first valve assembly 170 can be operated according to a difference of back pressure applied by the second valve assembly 180.

Here, the second valve assembly 180 may be configured as a solenoid valve and disposed in the inner space of the casing 110. However, in order to enhance a degree of freedom to design of a specification of the second valve assembly 180, the second valve assembly 180 may preferably be disposed outside the casing 110. The present invention basically illustrates an example that the second valve assembly is disposed outside the casing.

As illustrated in FIGS. 3 and 4, the second valve assembly 180 is fixed to an outer circumferential surface of the casing 110 using a bracket 180*a*. However, in some cases, the second valve assembly 180 may be welded directly on the casing 110, without using a separate bracket.

Figure 10A:
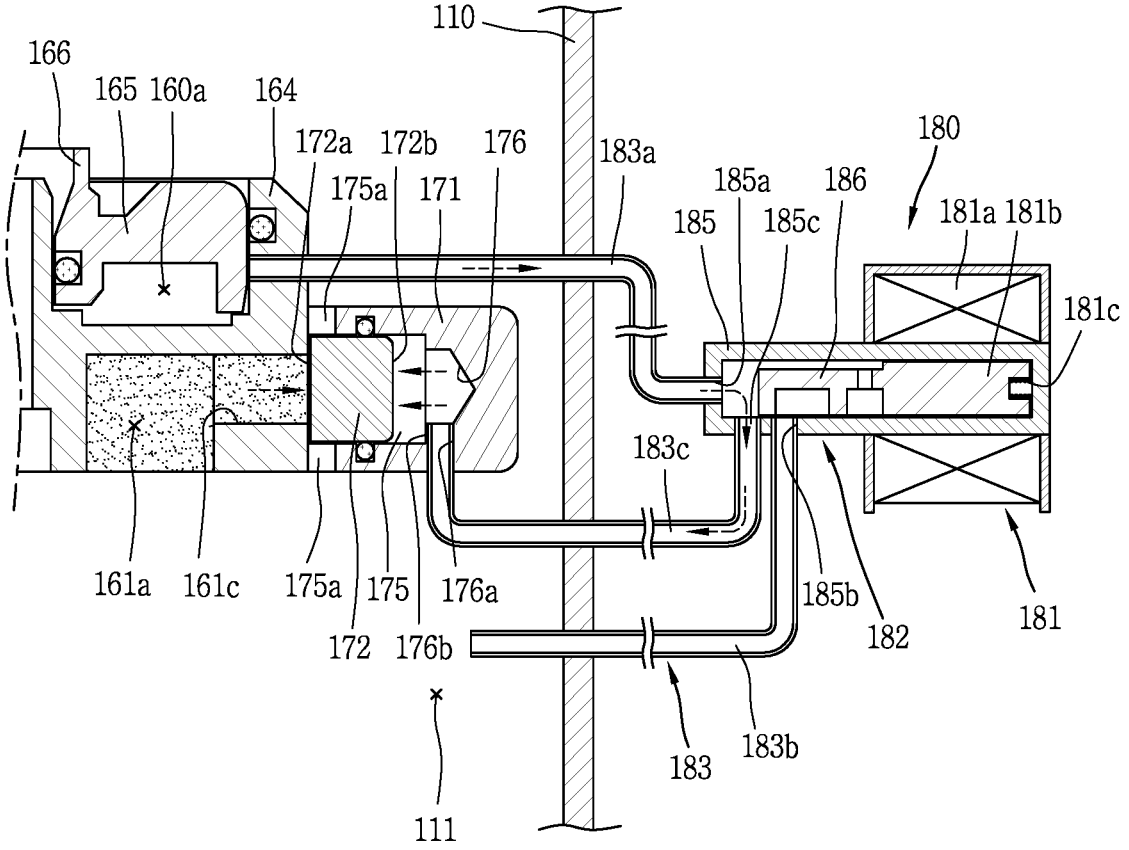
Figure 10B:
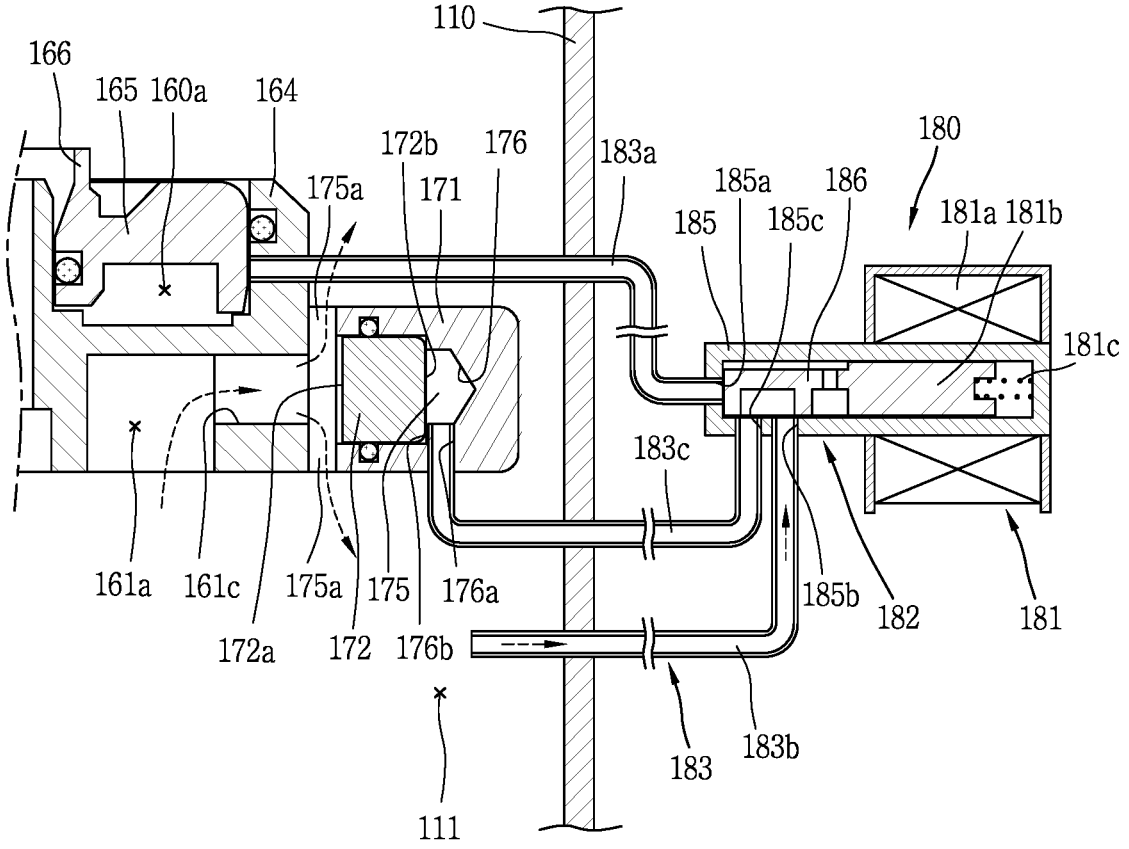

As illustrated in FIGS. 10A and 10B, the second valve assembly 180 is configured as a solenoid valve having a power supply unit 181 which is connected to an external power source such that a mover 181*b* is selectively operated according to supply or non-supply of external power.

The power supply unit 181 includes a mover 181*b* provided at an inner side of a coil 181*a* to which power is applied, and a return spring 181*c* provided on one end of the mover 181*b*. The mover 181*b* is coupled with a valve 186 that communicates a first inlet/outlet port 185*a* and a third inlet/outlet port 185*c* to be explained later with each other or communicates a second inlet/outlet port 185*b* and the third inlet/outlet port 185*c* with each other. Accordingly, when power is applied to the coil 181*a*, the mover 181*b* and the valve 186 coupled to the mover 181*b* are moved in a first direction (in a direction of closing the discharge hole) so as to communicate corresponding connection pipes 183*a* and 183*c* with each other. On the other hand, when power is off, the mover 181*b* is returned in a second direction (in a direction of opening the discharge hole) by the return spring 181*c* so as to communicate other connection pipes 183*b* and 183*c* with each other. This results in switching a flowing direction of a refrigerant that flows toward the first valve assembly 170 according to an operating mode of the compressor.

A valve portion 182 which is operated by the power supply unit 181 and switches the flowing direction of the refrigerant is coupled to one side of the power supply unit 181.

The valve portion 182 is configured in a manner that the valve 186 provided at the mover 181*b* of the power supply unit 181 is slid into a valve housing 185 coupled to the power supply unit 181. Of course, according to the configuration of the power supply unit 181, the switching valve 186 may also switch the flowing direction of the refrigerant in a rotating manner, other than a reciprocating manner. However, this embodiment basically illustrates a linear reciprocating valve for the sake of explanation.

The valve housing 185 is formed in a long cylindrical shape and has three inlet/output ports along a lengthwise direction. The first inlet/outlet port 185*a* is connected to the back pressure chamber 160*a* through the first connection pipe 183*a* to be explained later, the second inlet/outlet port 185*b* is connected to the low pressure portion 111 of the casing 110 through the second connection pipe 183*b* to be explained later, and the third inlet/outlet port 185*c* is connected to the differential pressure space 176 of the first valve assembly 170 through the third connection pipe 183*c* to be explained later. In the drawing, the first inlet/outlet port 185*a* and the second inlet/outlet port 185*b* are located at both sides with the third inlet/outlet port 185*c* located therebetween. However, this may vary according to the configuration of the valve.

Figure 8:
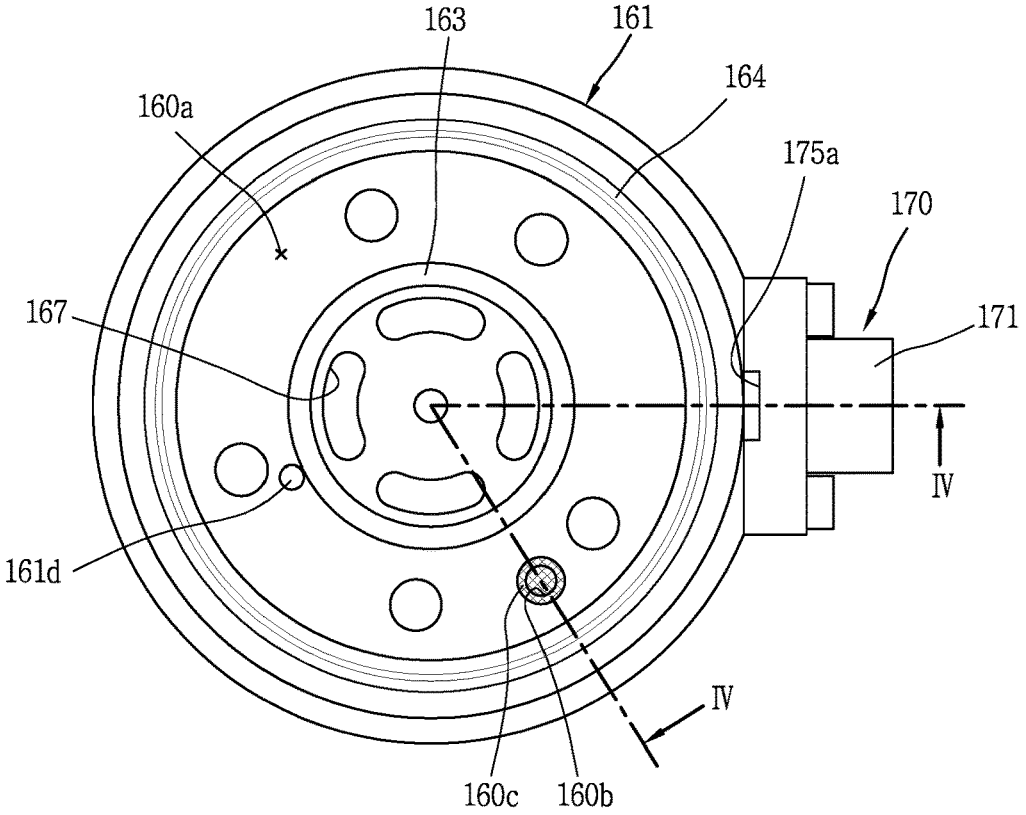
FIG. 8 is a top sectional view of the back pressure plate in FIG. 3.
Figure 9:
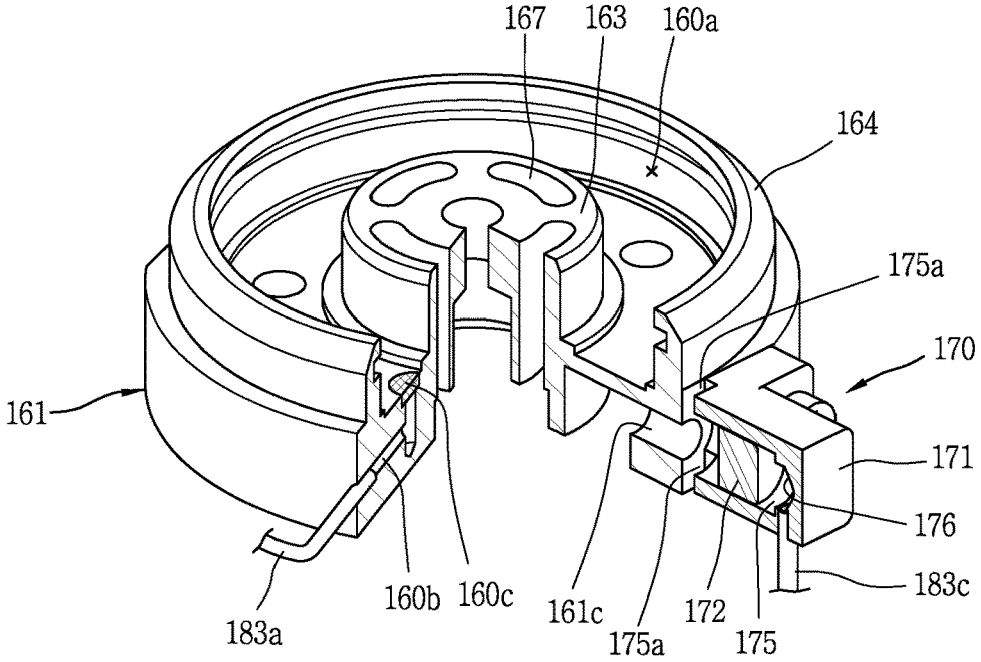
FIG. 9 is a sectional view taken along the line "IV-IV" of FIG. 8.

Here, in order to connect the first inlet/outlet port 185*a* of the second valve assembly 180 to the back pressure chamber 160*a* through the first connection pipe 183*a*, an intermediate pressure hole 160*b* should be formed in a manner of penetrating through an outer circumferential surface of the back pressure plate 161 or an outer circumferential surface of the non-orbiting scroll 150, starting from the back pressure chamber 160*a*. FIGS. 8 and 9 illustrate an example in which the intermediate pressure hole 160*b* is formed from a bottom surface of the back pressure chamber 160*a* to the outer circumferential surface of the back pressure plate 161 in a penetrating manner.

Also, the intermediate pressure hole 160*b* may be provided with a filter 160*c* to prevent foreign materials remaining in the back pressure chamber 160*a* from being introduced into the intermediate pressure hole 160*b*. The filter 160*c* may preferably be inserted into an extending recess (no reference numeral given) that is formed on an inlet of the intermediate pressure hole 160*b*, namely, an end portion of the bottom surface of the back pressure chamber 160*a*.

Meanwhile, a connecting portion 183 which transfers a refrigerant whose flowing direction is switched by the valve portion 182 to the first valve assembly 170 is coupled to the valve portion 182 through the casing 110.

The connecting portion 183 includes a first connection pipe 183*a*, a second connection pipe 183*b* and a third connection pipe 183*c* for selectively injecting a refrigerant of intermediate pressure or suction pressure into the first valve assembly 170. The first connection pipe 183*a*, the second connection pipe 183*b* and the third connection pipe 183*c* are inserted through the casing 110 and welded on the casing 110. Each connection pipe may be made of the same material as the casing 110, but alternatively made of a different material from the casing. When being made of the different material, the connection pipe may be welded on the casing using an intermediate member, considering the welding operation on the casing.

Also, each connection pipe 183*a*, 183*b* and 183*c* may be individually welded on the casing 110 in a penetrating manner. In this instance, however, it is not preferable, considering that a diameter of each connection pipe is not great. Therefore, after coupling a connection member to the casing, the connection pipes may be assembled with inner and outer side surfaces of the connection member. In this instance, preferably, after a portion of each connection pipe may be coupled to one side surface of the connection member in advance, the connection pipe is coupled to the casing, and thereafter the portion of each connection pipe is connected to another side surface of the connection member.

For example, as illustrated in FIG. 4, a connection member 184 is formed in a cylindrical shape. The connection member 184 may also be coupled to the casing 110 in a state that the three connection pipes 183*a*, 183*b* and 183*c* are all inserted therethrough. In this instance, in a state that the connection member 184 is closely adhered on each of the connection pipes 183*a*, 183*b* and 183*c* by applying external force to the connection member 184 after coupling the connection member 184 to the casing 110, the connection member 184 may be welded on each of the connection pipes 183*a*, 183*b* and 183*c*, Or, in a state that the connection member 184 is closely adhered on each of the connection pipes 183*a*, 183*b* and 183*c* by applying external force to the connection member 184, the connection member 184 may be welded on each of the connection pipes and then inserted in and welded on the casing 110.

One end of the first connection pipe 183*a* is connected to the first inlet/outlet port 185*a* of the valve housing 185 and another end of the first connection pipe 183*a* is connected to the intermediate pressure hole 160*b* which communicates with the back pressure chamber 160*a*. One end of the second connection pipe 183*b* is connected to the second inlet/outlet port 185*b* of the valve assembly 185 and another end of the second connection pipe 183*b* is connected to the low pressure portion 111 of the casing 110. One end of the third connection pipe 183*c* is connected to the third inlet/outlet of the valve housing 185 and another end of the third connection pipe 183*c* is connected to the injection hole 176*a* which communicates with the differential pressure space 176 of the first valve assembly 170.

An unexplained reference numeral 158 denotes a gasket.

Hereinafter, an operation of the scroll compressor according to the embodiment of the present invention will be described.

That is, during a power operation (mode), as illustrated in FIG. 10A, power is applied to the power supply unit 181 of the second valve assembly 180 and thus the mover 181*b* is pulled toward the coil 181*a*.

The switching valve 186 coupled to the mover 181*b* is then moved toward the coil 181*a* (to right in the drawing), such that the first inlet/outlet port 185*a* and the third inlet/outlet port 185*c* of the valve housing 185 communicate with each other.

Accordingly, a refrigerant of intermediate pressure within the back pressure chamber 160*a* flows toward the valve housing 185 through the first connection pipe 183*a* connected to the first inlet/outlet port 185*a*, and then flows into the differential pressure space 176 of the first valve assembly 170 through the third connection pipe 183*c* connected to the third inlet/outlet port 185*c*.

Pressure of the differential pressure space 176 thus becomes intermediate pressure. Due to the intermediate pressure, the piston valve 172 of the first valve assembly 170 is pushed toward the discharge hole 161*c*, thereby closing the discharge hole 161*c*. In this instance, a front side, namely, the open/close surface 172*a* of the piston valve 172 is brought into contact with the discharge hole 161*c*, which is also under intermediate pressure. However, since the sectional area A3 of the discharge hole 161*c* is smaller than the sectional area A1 of the differential pressure space 176, the piston valve 172 is moved toward the discharge hole 161*c* and closes the discharge hole 161*c*.

In this state, although the refrigerant stored in the intermediate pressure chamber of the compression chamber P is partially discharged into the valve accommodation groove 161*a* through the bypass hole 151*b* in a manner of opening the check valve 155, the refrigerant is maintained in a state of being filled in the valve accommodation groove 161*a*, the communication groove 161*b* and the discharge hole 161*c*. Accordingly, the refrigerant does not flow out of the compression chamber P any more, which results in continuing the power operation of the compressor.

On the other hand, during a saving operation (mode), as illustrated in FIG. 10B, power supplied to the power supply unit 181 of the second valve assembly 180 is blocked, and thereby the mover 181*b* is pushed opposite to the coil 181*a* by the return spring 181*c*.

The switching valve 186 coupled to the mover 181*b* is then moved to an opposite side of the coil 181*a* (to left in the drawing), such that the second inlet/outlet port 185*b* and the third inlet/outlet port 185*c* of the valve housing 185 communicate with each other.

In turn, the valve housing 185 communicates with the low pressure portion 111 of the casing 110 through the second connection pipe 183*b* connected to the second inlet/outlet port 185*b*. Accordingly, a refrigerant of suction pressure flows into the valve housing 185 and then flows into the differential pressure space 176 of the first valve assembly 170 through the third connection pipe 183*c* connected to the third inlet/outlet port 185*c*.

Pressure of the differential pressure space 176 thus becomes suction pressure. The piston valve 172 of the first valve assembly 170 is then pushed toward the differential pressure space 176 by the pressure of the discharge hole 161*c*, thereby opening the discharge hole 161*c*.

Accordingly, a refrigerant which is already filled in the valve accommodation groove 161*a*, the communication groove 161*b* and the discharge hole 161*c* is fast discharged into the valve space 175 of the first valve assembly 170 through the check valve 155. The refrigerant is then discharged into the low pressure portion 111 of the casing 110 through the exhaust holes 175*a* formed on the valve space 175. A part of the refrigerant filled in the intermediate pressure chamber of the compression chamber P is continuously discharged along the path, thereby continuing the saving operation of the compressor.

With the configuration, a refrigerant compressed in an intermediate pressure chamber during over-compression can partially be bypassed, which may result in enhancing efficiency of the compressor.

Also, a valve which opens and closes a bypass passage of a refrigerant may be configured as a first valve assembly that is operated by a pressure difference, and the first valve assembly may be configured as a piston valve that is disposed outside a non-orbiting scroll and a back pressure plate and operated in response to a less pressure variation. This may allow for fast switching an operating mode of the compressor.

In addition, the first valve assembly may be disposed on an end portion of a discharge passage for a refrigerant. Accordingly, the refrigerant may already stay near an outlet port of the passage when a power operation is switched into a saving operation, which may thus allow for fast switching into the saving operation that much.

A valve that operates the first valve assembly may be configured as a second valve assembly which is configured in an electric form. This may reduce a number of components and simplify a passage for bypassing a refrigerant, thereby facilitating a fabrication and enhancing reliability for a switching operation of the first valve assembly.

As the second valve assembly is provided outside the casing, a size restriction for the second valve assembly can be more relaxed than installing the second valve assembly within the casing. This may allow the second valve assembly to be configured by using standardized components, thereby reducing fabricating costs.

Also, as the second valve assembly is provided outside the casing, unlike installing the second valve assembly within the casing, an additional terminal for supplying power does not have to be provided, which may prevent an increase in the number of components and the number of assembly processes of the components, thereby reducing fabricating costs.

Figure 11:
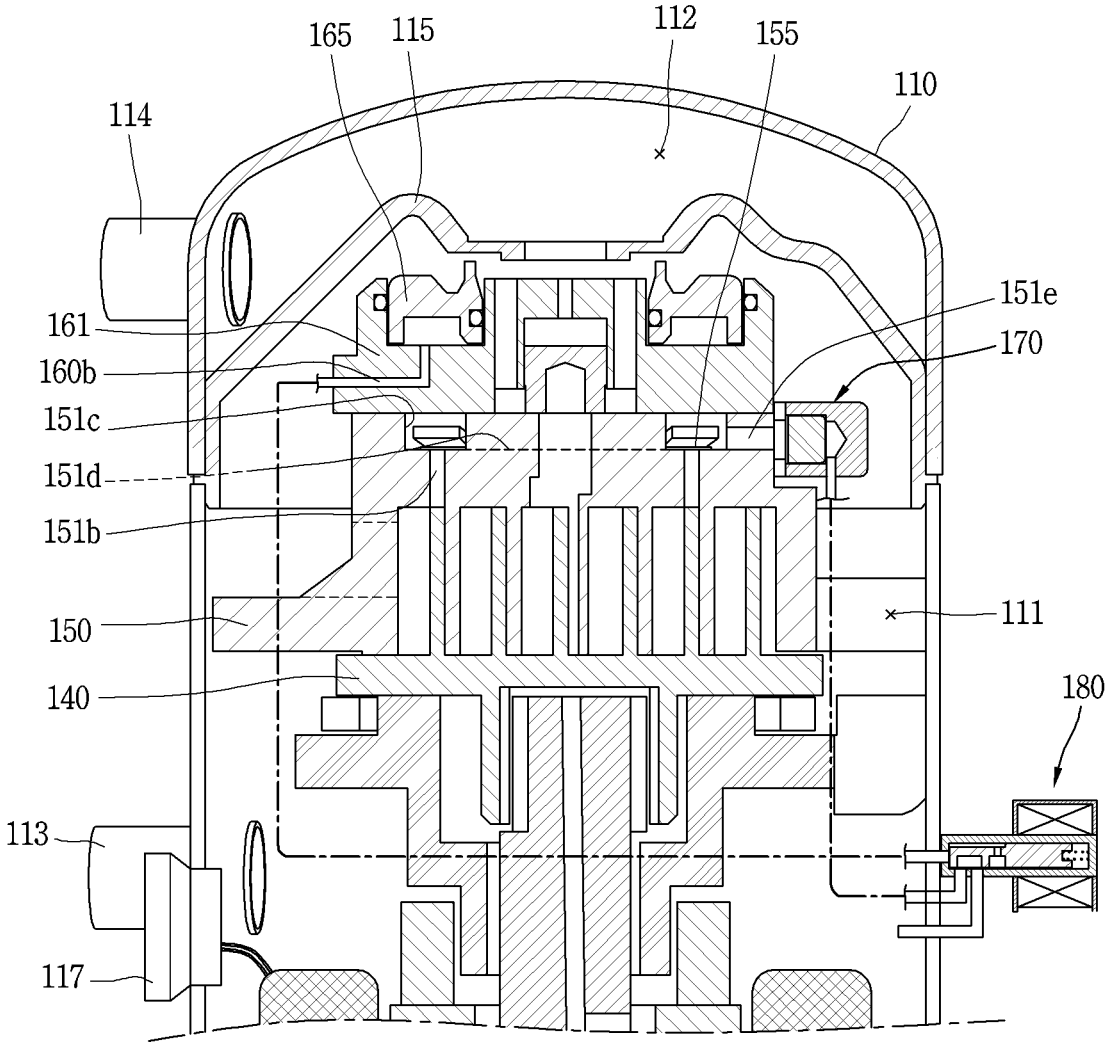
FIG. 11 is a longitudinal sectional view illustrating an example that the capacity varying apparatus is provided on a non-orbiting scroll in the scroll compressor according to FIG. 3.

Meanwhile, the valve accommodation grooves, the communication groove and the discharge hole may be formed on a rear surface of the disk portion 151 of the non-orbiting scroll 150. That is, as illustrated in FIG. 11, a plurality of valve accommodation grooves 151*c* are recessed by predetermined depths into the rear surface of the disk portion 151 of the non-orbiting scroll 150, respectively, and a communication groove 151*d* is recessed by a predetermined depth between the plurality of valve accommodation grooves 151*c*. Also, a discharge hole 151*e* may be formed from the valve accommodation groove 151*c* or the communication groove 151*d* to the outer circumferential surface of the non-orbiting scroll 150 in a penetrating manner.

As aforementioned, even when the valve accommodation grooves 151*c*, the communication groove 151*d* and the discharge hole 151*e* are formed on the rear surface of the disk portion 151 of the non-orbiting scroll 150, the basic construction and operation effects are the same as or similar to those of the aforementioned embodiment. However, as illustrated in this embodiment, when the valve accommodation grooves 151*c*, the communication groove 151*d* and the discharge hole 151*e* are formed on the rear surface of the disk portion 151 of the non-orbiting scroll 150, lengths of the bypass holes 151*b* may be reduced, thereby reducing a dead volume.

Meanwhile, the scroll compressor continuously operates while a gap between the high pressure portion and the low pressure portion is blocked. When a usage environmental condition for the compressor is changed, temperature of the discharge space of the high pressure portion may increase up to a preset temperature or more. In this instance, some components of the compressor may be damaged due to such high temperature.

Figure 12:
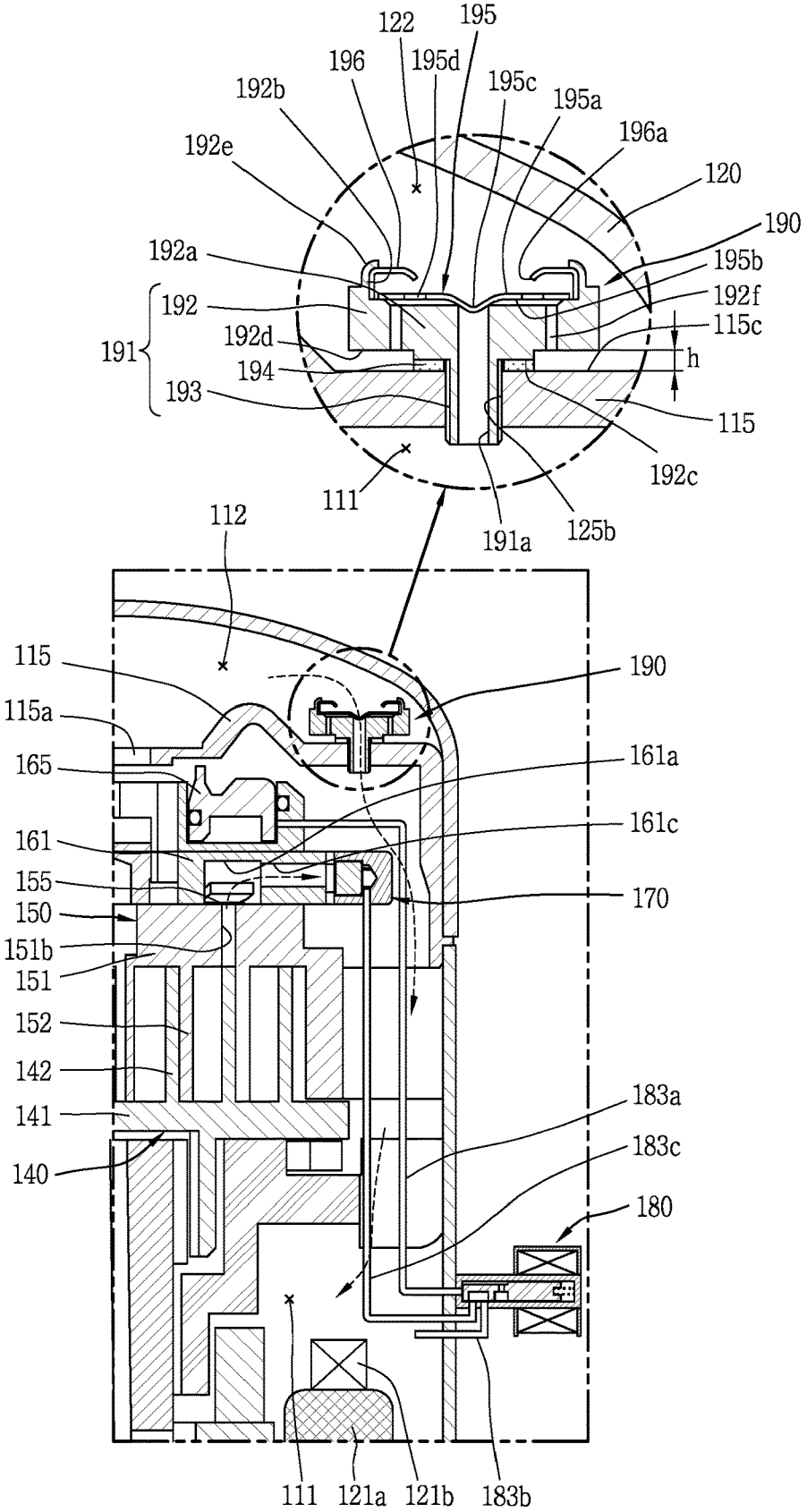
FIG. 12 is a longitudinal sectional view illustrating an example that an overheat preventing unit is provided in the scroll compressor according to FIG. 3.

Considering this, as illustrated in FIG. 12, an overheat preventing unit 190 may be disposed on the high/low pressure dividing plate 115 according to this embodiment. The overheat preventing unit 190 according to this embodiment may communicate the high pressure portion 112 and the low pressure portion 111 with each other such that a refrigerant of the high pressure portion 112 is leaked into the low pressure portion 111, when temperature of the high pressure portion 112 is raised up to a preset temperature or more. The leaked hot refrigerant arouses an operation of an overload breaker 121*b* provided on an upper end of the winding coil 121*a* of the stator 121, thereby stopping the operation of the compressor. Therefore, the overheat preventing unit 190 is preferably configured to be sensitive to temperature of the discharge space.

The overheat preventing unit 190 according to this embodiment may be spaced apart from the high/low pressure dividing plate 115 by a predetermined interval, if possible, taking into account the point that the high/low pressure dividing plate 115 is formed of a thin plate material and divides the high pressure portion 112 and the low pressure portion 111. This may allow the overheat preventing unit 190 to be less affected in view of temperature by the low pressure portion 111 with relatively low temperature.

In more detail, the overheat preventing unit 190 according to this embodiment may be provided with a body 191 which is separately fabricated to accommodate a valve plate 195, and the body 191 may then be coupled to the high/low pressure dividing plate 115. Accordingly, the high/low pressure dividing plate and the valve plate may be spaced apart from each other by a predetermined interval, such that the valve plate can be less affected by the high/low pressure dividing plate.

The body 191 may be made of the same material as the high/low pressure dividing plate 115. However, the body 191 may preferably be made of a material with a low heat transfer rate, in terms of insulation. The body 191 may be provided with a valve accommodating portion 192 having a valve space, and a coupling portion 193 protruding from a center of an outer surface of the valve accommodating portion 192 by a predetermined length and coupling the body 191 to the high/low pressure dividing plate 115.

The valve accommodating portion 192 includes a mounting portion 192*a* formed in a disk-like shape and having the valve plate 195 mounted on an upper surface thereof, and a side wall portion 192*b* extending from an edge of the mounting portion 192*a* into an annular shape and forming the valve space together with an upper surface of the mounting portion 192*a*. The mounting portion 192*a* may be thicker than the side wall portion 192*b* in thickness. However, when the mounting portion is thicker, an effect of holding heat may be generated. Therefore, the thickness of the mounting portion may alternatively be thinner than that of the side wall portion within a range of ensuring reliability.

A stepped surface 192*c* supported by the high/low pressure dividing plate 115 is formed on a lower surface of the mounting portion 192*a*. Accordingly, a lower surface of an outer mounting portion 192*d* which is located outside the stepped surface 192*c* of the lower surface of the mounting portion 192*a* may be spaced apart from an upper surface 115*c* of the high/low pressure dividing plate 115 by a predetermined height (interval) h. This may result in reducing a contact area between the body and the high/low pressure dividing plate and simultaneously enhancing reliability by allowing a refrigerant of the discharge space to be introduced between the body and the high/low pressure dividing plate.

However, an insulating material, such as a gasket 194, which serves as a sealing member, may preferably be provided between the stepped surface 192*c* and the high/low pressure dividing plate 115, in the aspect of preventing heat transfer between the body 191 and the high/low pressure dividing plate 115.

Also, a communication hole 191*a* through which the high pressure portion 112 and the low pressure portion 111 communicate with each other is formed from a center of the upper surface of the mounting portion 192*a* to a lower end of the coupling portion 193. A damper (not illustrated) in which a sealing protrusion 195*c* of the valve plate 195 is inserted may be formed in a tapering manner on an inlet of the communication hole 191*a*, namely, an end portion of the upper surface of the mounting portion 192*a*.

A supporting protrusion 192*e* is formed on an upper end of the side wall portion 192*b*. The supporting protrusion 192*e* is bent after inserting a valve stopper 196 therein, so as to support the valve stopper 196. The valve stopper 196 may be formed in a ring shape with a first gas hole 196*a* formed at a center thereof to allow a refrigerant of the high pressure portion 112 to always come in contact with a first contact surface 195*a* of the valve plate 195.

Here, the mounting portion 192*a* may be provided with at least one second gas hole 192*f* through which the refrigerant of the high pressure portion 112 always comes in contact with a second contact surface 195*b* of the valve plate 195. Accordingly, the refrigerant of the discharge space may come in contact directly with the first contact surface 195*a* of the valve plate 195 through the first gas hole 196*a* and simultaneously come in contact directly with the second contact surface 195*b* of the valve plate 195 through the second gas hole 192*f*. This may result in reducing a temperature difference between the first contact surface 195*a* and the second contact surface 195*b* of the valve plate 195 and simultaneously increasing a responding speed of the valve plate 195.

The valve plate 195 may be configured as a bimetal to be thermally transformed according to temperature of the high pressure portion 112 and thereby open and close the communication hole 191*a*. The sealing protrusion 195*c* protrudes from a central portion of the valve plate 195 toward the communication hole 191*a*, and a plurality of refrigerant holes 195*d* through which the refrigerant flows during an opening operation are formed around the sealing protrusion 195*c*.

Meanwhile, a thread is formed on an outer circumferential surface of the coupling portion 193 such that the coupling portion 193 can be screw-coupled to a coupling hole 115*b* provided on the high/low pressure dividing plate 115. However, in some cases, the coupling portion 193 may be press-fitted into the coupling hole 115*b* or coupled to the coupling hole 115*b* in a welding manner or by using an adhesive.

The overheat preventing unit of the scroll compressor according to this embodiment may extend a path along which low refrigerant temperature of the low pressure portion 111 is transferred to the valve plate 195 by a heat transfer through the high/low pressure dividing plate 115, which may increase an insulating effect and accordingly allow the valve plate 195 to be much less affected by the temperature of the low pressure portion 111.

On the other hand, the valve plate 195 may be located in the discharge space of the high pressure portion 122 by being spaced apart from the upper surface 115*c* of the high/low pressure dividing plate 115, adjacent to the high pressure portion 112, by the predetermined height h. Accordingly, the valve plate 195 may be mostly affected by the temperature of the high pressure portion 112, and thus sensitively react with respect to the increase in the temperature of the high pressure portion 112.

Accordingly, when the temperature of the high pressure portion increases up to a set value or more, the valve plate may fast be open and the refrigerant of the high pressure portion may fast flow toward the low pressure portion through the bypass holes. The refrigerant arouses the operation of the overload breaker provided in the driving motor and thereby the compressor is stopped. With the configuration, the overheat preventing unit can correctly react with the operating state of the compressor without distortion, thereby preventing damage on the compressor due to high temperature in advance.

Hereinafter, another embodiment of a scroll compressor having a capacity varying apparatus according to the present invention will be described.

That is, the foregoing embodiment has illustrated that the control valve for varying the capacity is configured as a plurality of valve assemblies. However, this embodiment illustrates that a control valve is configured as one valve assembly. Also, the foregoing embodiment has illustrated that the first valve assembly is disposed outside the non-orbiting scroll and the back pressure chamber assembly, but this embodiment illustrates that a check valve corresponding to the first valve assembly is disposed between the non-orbiting scroll and the back pressure chamber assembly.

Figure 13:
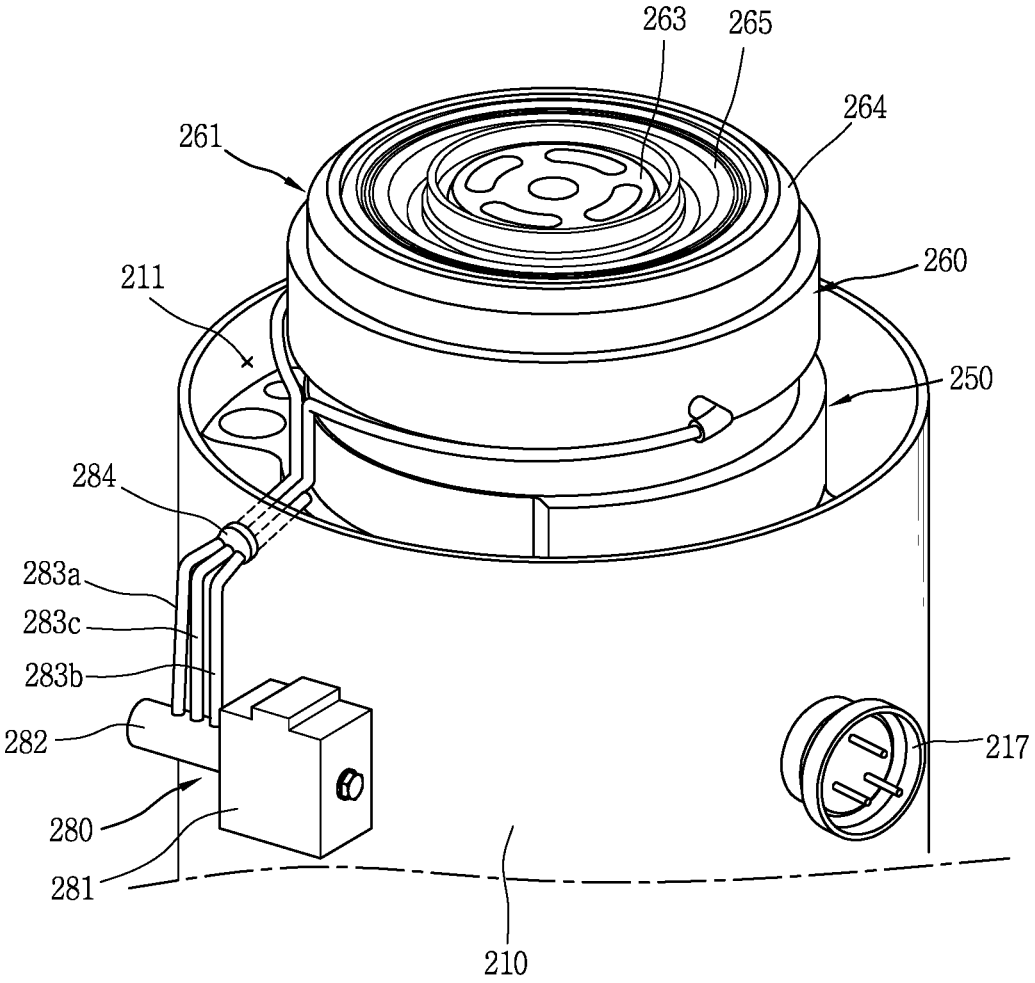
FIG. 13 is a perspective view illustrating a scroll compressor having a capacity varying apparatus in accordance with an embodiment of the present invention.
Figure 14:
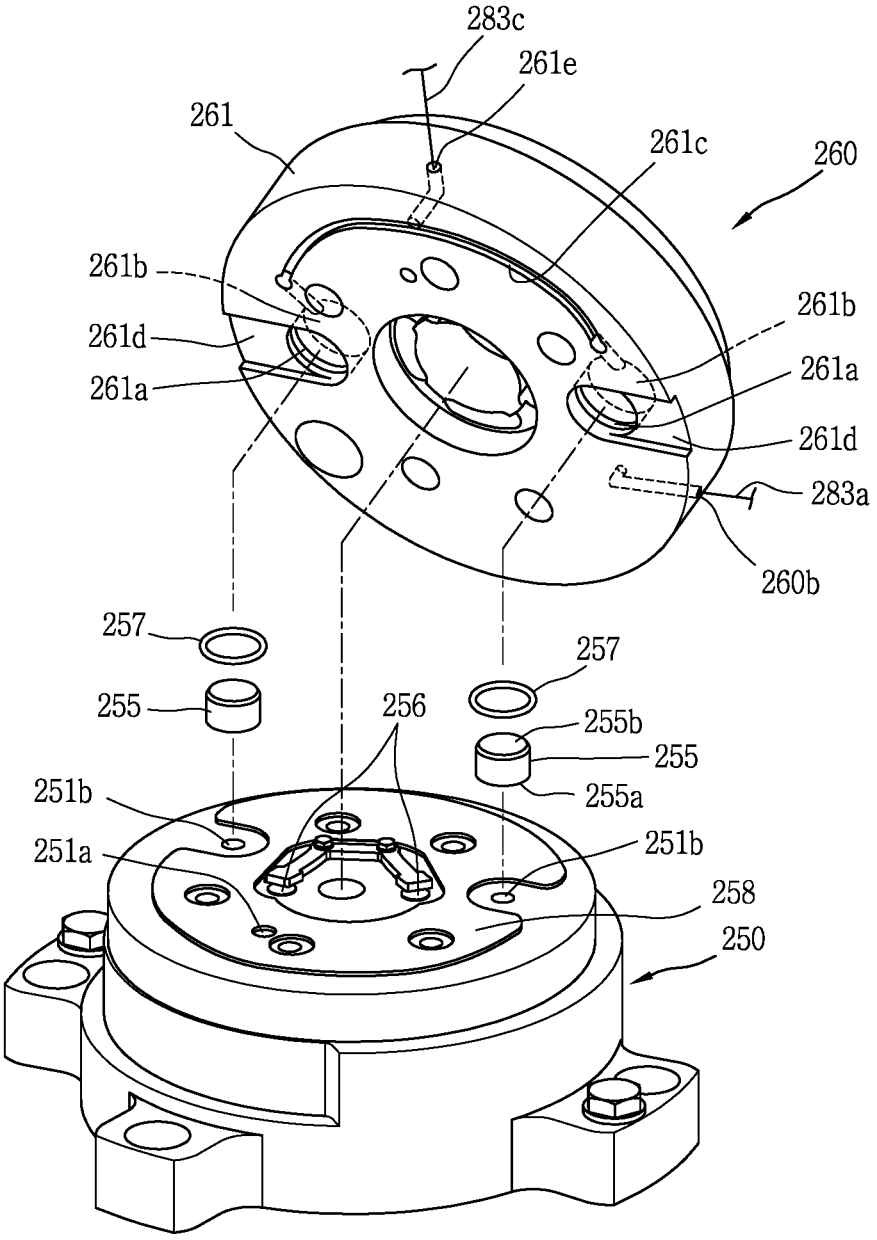
FIG. 14 is an exploded perspective view of the capacity varying apparatus in FIG. 13.
Figure 15A:
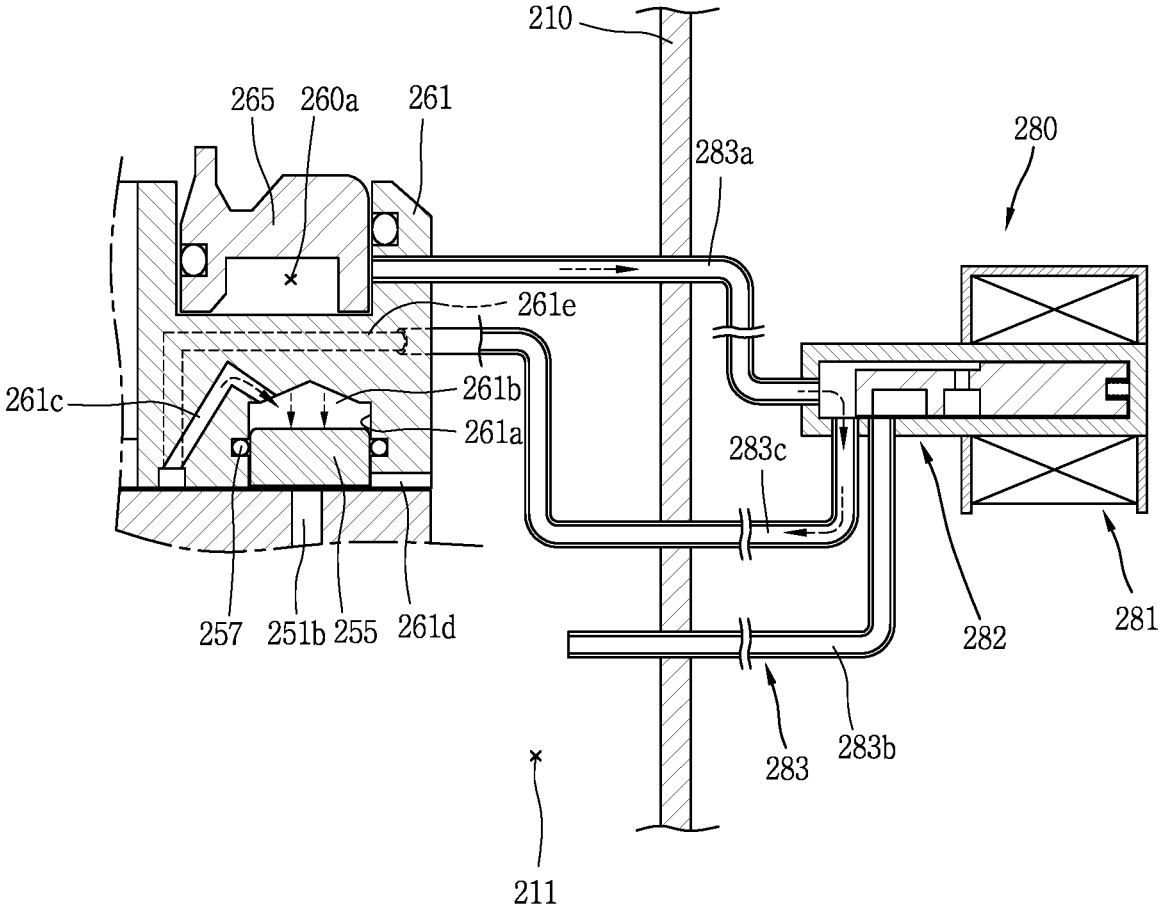
Figure 15B:
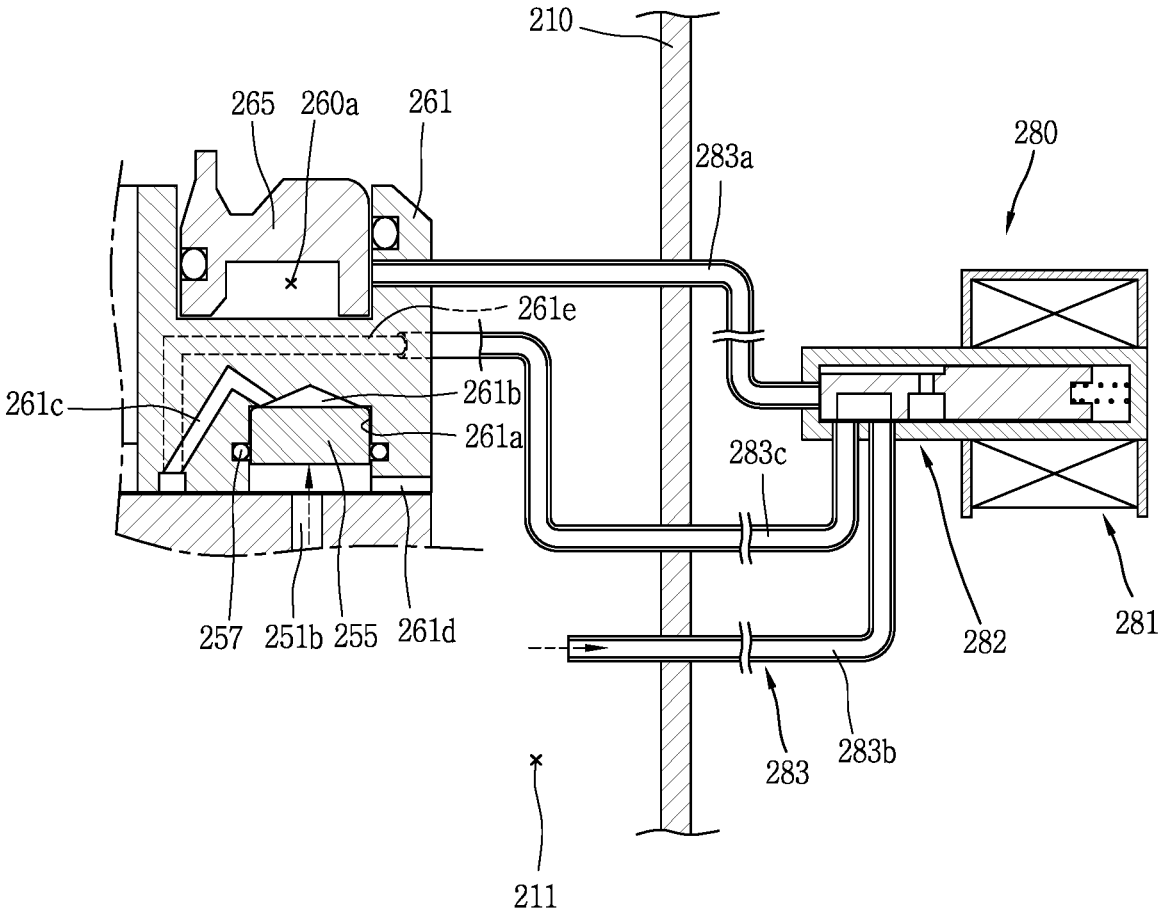

FIG. 13 is a perspective view illustrating a scroll compressor having a capacity varying apparatus in accordance with an embodiment of the present invention, FIG. 14 is an exploded perspective view of the capacity varying apparatus in FIG. 13, and FIGS. 15A and 15B are schematic views illustrating operations of a check valve and a valve assembly according to an operating mode of the compressor in FIG. 13, wherein FIG. 15A illustrates a power mode, and FIG. 15B illustrates a saving mode.

In this embodiment, instead of integrating the check valve and the first valve assembly illustrated in the foregoing embodiment into a single check valve, the check valve may be controlled by a valve assembly corresponding to the second valve assembly of the foregoing embodiment.

As illustrated in FIGS. 13 and 14, a back pressure plate 261 according to this embodiment includes first and second annular walls 263 and 264 provided on an upper surface thereof to form a back pressure chamber 260*a*, and an intermediate pressure hole 260*b* formed from a bottom surface of the back pressure chamber 260*a* to an outer circumferential surface of the back pressure plate 261 to guide a part of a refrigerant in the back pressure chamber 260*a* into a first connection pipe 283*a* which will be explained later.

Also, a plurality of valve spaces 261*a*, in which a plurality of piston valves 255 configuring a check valve are slidably inserted in an axial direction, are recessed into a lower surface of the back pressure plate 261 by predetermined depths. A differential pressure space 261*b* is formed at one side of each valve space in an axial direction with interposing the piston valve 255 therebetween. That is, the differential pressure space 261*b* is located adjacent to a rear surface of the piston valve 255.

The differential pressure spaces 261*b* and the valve spaces 261*a* are formed with a phase difference of 180°, respectively, in a facing manner Both of the differential pressure spaces 261*b* communicate with each other by a connection passage groove 261*c* which is formed on a lower surface of the back pressure plate 261. In this instance, as illustrated in FIG. 14, both ends of the connection passage groove 261*c* are inclined toward the differential pressure spaces 261*b*, respectively. A horizontal sectional area of the differential pressure space 261*b* is greater than a horizontal sectional area of each bypass hole 251*b*. The connection passage groove 261*c* preferably overlaps a gasket 258, which is provided on an upper surface of a non-orbiting scroll 250, so as to be sealed.

Also, outlet grooves 261*d* are independently formed on the valve spaces 261*a*, respectively, such that a refrigerant discharged from an intermediate compression chamber is discharged into a low pressure portion 211 of a casing 210 through the bypass holes 251*b* when the piston valves 255 are open. The outlet grooves 261*d* are formed from inner circumferential surfaces of the valve spaces 261*a* toward an outer circumferential surface of the back pressure plate 261 in a radial direction.

Meanwhile, a differential pressure hole 261*e* is formed on a middle portion of the connection passage groove 261*c* and connected to a third connection pipe 283*c* which will be explained later. However, the differential pressure hole 261*e* may alternatively be connected directly to one of both differential pressure spaces 261*b*.

The differential pressure hole 261*e* may be connected to a valve assembly 280 through the third connection pipe 283*c*. Here, basic configurations and operations of the valve assembly 280 and a first connection pipe 283*a*, a second connection pipe 283*b* and the third connection pipe 283*c* connected to the valve assembly 280 are similar to those of the aforementioned embodiment, so detailed description will be omitted.

However, this embodiment is different from the foregoing embodiment in a flowing direction of a refrigerant discharged through a bypass hole, so description will be given based on the difference.

An unexplained reference numeral 217 denotes a terminal, 251*a* denotes a scroll-side back pressure hole, 255*a* denotes an open/close surface, 255*b* denotes a back pressure surface, 256 denotes a bypass valve, 257 denotes an O-ring, 265 denotes a floating plate, 281 denotes a power supply unit, 282 denotes a valve portion, 283 denotes a connecting portion, and 284 denotes a connection member.

As illustrated in FIG. 15A, during a power operation mode of the compressor, a refrigerant of intermediate pressure is introduced into the differential pressure hole 261*e* via the first connection pipe 283*a* and the third connection pipe 283*c* by the valve assembly 280. The refrigerant introduced in the differential pressure hole 261*e* is then introduced into both of the differential pressure spaces 261*b* through the connection passage groove 261*c*.

Accordingly, pressure of each differential pressure space 261*b* becomes intermediate pressure and presses the back pressure surfaces 255*b* of the piston valves 255. In this instance, as the horizontal sectional area of each differential pressure space 261*b* is greater than that of each bypass hole 251*b*, both of the piston valves 255 are pushed by the pressure of the differential pressure spaces 261*b*, thereby closing the bypass holes 251*b*, respectively.

This may result in preventing the refrigerant of the compression chamber from being leaked into the bypass holes 251*b*, and thus allowing for continuing the power operation.

On the other hand, as illustrated in FIG. 15B, during a saving operation mode of the compressor, a refrigerant of suction pressure is introduced into the differential pressure hole 261*e* via the second connection pipe 283*b* and the third connection pipe 283*c* by the valve assembly 280. The refrigerant introduced into the differential pressure hole 261*e* is then introduced into both of the differential pressure spaces 261*b* through the connection passage groove 261*c*.

Accordingly, pressure of each differential pressure space 261*b* becomes suction pressure and thus presses the back pressure surfaces 255*b* of the piston valves 255. In this instance, as pressure of the intermediate compression chamber becomes higher than that of the differential pressure spaces 261*b*, both of the piston valves 255 are pushed up by the pressure of the intermediate compression chamber, respectively.

Both of the bypass holes 251*b* are thus open, such that the refrigerant in the intermediate compression chamber is discharged toward the low pressure portion 211 of the casing 210 through the outlet grooves 261*d*, respectively, thereby executing the saving operation of the compressor.

The scroll compressor having the capacity varying apparatus according to this embodiment provides the same/like operation effects to those of the foregoing embodiments.

Here, unlike the foregoing embodiment, this embodiment may allow both of the bypass holes 251*b* to independently communicate with the low pressure portion 211 of the casing 210 through the outlet grooves 261*d*, respectively.

Accordingly, the refrigerants which are bypassed in the compression chambers through both of the bypass holes 251*b* may not flow into one space but be discharged directly into the low pressure portion of the casing 210. This may prevent the refrigerant bypassed in the compression chambers from being heated by the refrigerant of the back pressure chamber 260*a*.

This may result in preventing in advance a reduction of a suction volume which results from an increase in a non-volume caused when the refrigerant bypassed from the compression chamber to the low pressure portion 211 of the casing 210 is heated.

Also, in the foregoing embodiment, the number of components and the number of assembly processes may increase because the first valve assembly is disposed outside the non-orbiting scroll and the back pressure chamber assembly. However, as illustrated in this embodiment, the check valves 255 functioning as the first valve assembly can be disposed between the non-orbiting scroll 250 and the back pressure chamber assembly 260, whereby the number of assembly processes can be greatly reduced, thereby reducing fabricating costs.

Meanwhile, although not illustrated, the valve spaces, the differential pressure spaces and the outlet grooves may not be formed on the lower surface of the back pressure plate but formed on the upper surface of the non-orbiting scroll. In this instance, the connection passage grooves may also be formed on the upper surface of the non-orbiting scroll.

The foregoing embodiments have exemplarily illustrated a low pressure type scroll compressor, but the present invention can be equally applied to any hermetic compressor in which an inner space of a casing is divided into a low pressure portion as a suction space and a high pressure portion as a discharge space.

It should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Therefore, an aspect of the detailed description is to provide a scroll compressor capable of reducing fabricating costs by simplifying a structure of a capacity varying apparatus.

Another aspect of the detailed description is to provide a scroll compressor capable of relaxing restrictions on components constructing a capacity varying apparatus.

Another aspect of the detailed description is to provide a scroll compressor capable of easily supplying power for operating a capacity varying apparatus.

Another aspect of the detailed description is to provide a scroll compressor capable of enhancing responsiveness by simplifying a control of a capacity varying apparatus.

Another aspect of the detailed description is to provide a scroll compressor capable of preventing in advance efficiency of the compressor from being lowered due to overcompression, by employing a bypass hole and a check valve for opening and closing the bypass hole.

Another aspect of the detailed description is to provide a scroll compressor capable of enhancing a degree of freedom to design by providing a control valve for varying a capacity at an outside of a casing.

Another aspect of the detailed description is to provide a scroll compressor capable of reducing fabricating costs by employing a cheap standardized component as a control valve for varying a capacity.

Another aspect of the detailed description is to provide a scroll compressor which does not need to install a separate terminal for supplying power to a control valve on a casing.

Another aspect of the detailed description is to provide a scroll compressor, capable of reducing the number of components and the number of assembly processes by installing a check valve for bypassing a refrigerant of a compression chamber even between a non-orbiting scroll and a back pressure assembly.

To achieve these and other advantages and in accordance with the purpose of this specification, as embodied and broadly described herein, there is provided a scroll compressor having a high/low pressure dividing plate for dividing an inner space of a casing into a high pressure portion and a low pressure portion, the compressor including a passage formed between a non-orbiting scroll and a back pressure chamber assembly to communicate from an intermediate pressure chamber to the low pressure portion, and a valve installed on the passage to open and close the passage.

Here, the scroll compressor may further include a check valve disposed at the passage and opened and closed according to a pressure difference of the intermediate pressure chamber.

To achieve these and other advantages and in accordance with the purpose of this specification, as embodied and broadly described herein, there is provided a scroll compressor, comprising: a casing; an orbiting member provided within the casing, and the orbiting member to perform an orbiting motion; a non-orbiting member, wherein the orbiting member and the non-orbiting member to form a compression chamber, the compression chamber having a suction chamber, an intermediate pressure chamber and a discharge chamber; a communication passage configured to allow a refrigerant of the compression chamber to flow; an opening/closing valve assembly configured to open and close the communication passage; and a switching valve assembly configured to control the opening/closing valve assembly, the switching valve assembly to be coupled to the opening/closing valve assembly, and the switching valve assembly to be provided outside the casing.

Here, the non-orbiting member includes a bypass hole to allow a refrigerant of the intermediate pressure chamber to at least partially pass, and wherein a check valve is provided at the bypass hole to open and close the bypass hole.

The opening/closing valve assembly is disposed at a backstream side rather than the check valve to open and close the communication passage that accommodates the check valve therein.

The opening/closing valve assembly is disposed outside the non-orbiting member.

The non-orbiting member includes a bypass hole to allow a refrigerant of the intermediate pressure chamber to at least partially pass, and wherein a portion of the opening/closing valve assembly is disposed on the bypass hole to open and close the bypass hole.

To achieve these and other advantages and in accordance with the purpose of this specification, as embodied and broadly described herein, there is provided a scroll compressor, comprising: a casing having a hermetic inner space separated into a low pressure portion and a high pressure portion; an orbiting scroll disposed within the inner space of the casing, and the orbiting scroll to perform an orbiting motion; a non-orbiting scroll, wherein the orbiting scroll and the non-orbiting scroll to provide a compression chamber, the compression chamber having a suction chamber, an intermediate pressure chamber and a discharge chamber; a back pressure chamber assembly coupled to the non-orbiting scroll to form a back pressure chamber; a bypass hole at the intermediate pressure chamber; a check valve provided at the bypass hole to open and close the bypass hole based on pressure at the intermediate pressure chamber; a communication passage formed at the back pressure chamber assembly or the non-orbiting scroll to provide communication between the bypass hole and the low pressure portion of the casing; a first valve assembly disposed on the back pressure chamber assembly or the non-orbiting scroll to selectively open and close the communication passage; and a second valve assembly to couple to the first valve assembly, and the second valve assembly to control opening and closing operations of the first valve assembly such that the first valve assembly opens and closes the communication passage.

Here, comprising a connection pipe that passes through the casing, wherein the second valve assembly is provided outside the casing, and the second valve assembly is to couple to the first valve assembly by at least the connection pipe.

The first valve assembly comprises: a valve guide having a valve space to provide communication with the communication passage, an exhaust hole to provide communication between the valve space and the low pressure portion, a differential pressure space at one side of the valve space, and an injection hole to provide communication between the differential pressure space and the second valve assembly such that pressure is applied to the differential pressure space; and a valve at the valve space to open and close a portion between the communication passage and the exhaust hole based on pressure at the differential pressure space.

The bypass hole includes a plurality of bypass holes, and the check valve includes a plurality of check valves to independently open and close the plurality of bypass holes, respectively.

Comprising a plurality of valve accommodation grooves and a communication groove, wherein the plurality of valve accommodation grooves are provided on the back pressure chamber assembly or the non-orbiting scroll, wherein the plurality of valve accommodation grooves to respectively accommodate the plurality of check valves, and the communication groove is provided between two of the plurality of valve accommodation grooves.

The second valve assembly comprises: a power supply to couple to an external power source, the power supply includes a mover; a valve portion to couple to the mover of the power supply, and the valve portion is to change a flow direction of a refrigerant; and a connecting portion to couple to the valve portion, and the connecting portion is provided through the casing such that the refrigerant, having the changed flow direction based on the valve portion, is provided to the first valve assembly.

The connecting portion comprises: a first connection pipe to allow a refrigerant of first pressure to flow toward the valve portion; a second connection pipe to allow a refrigerant of second pressure to flow toward the valve portion, the second pressure being less than the first pressure; and a third connection pipe to couple between the first valve assembly and the second valve assembly, and the third connection pipe is to selectively couple to the first connection pipe and the second connection pipe by the valve portion such that the first pressure or the second pressure is applied to the first valve assembly.

To achieve these and other advantages and in accordance with the purpose of this specification, as embodied and broadly described herein, there is provided a scroll compressor, comprising: a casing having a hermetic inner space separated into a low pressure portion and a high pressure portion; an orbiting scroll disposed within the inner space of the casing, and the orbiting scroll to perform an orbiting motion; a non-orbiting scroll, wherein the orbiting scroll and the non-orbiting scroll to provide a compression chamber, the compression chamber having a suction chamber, an intermediate pressure chamber and a discharge chamber; a back pressure chamber assembly to couple to the non-orbiting scroll to form a back pressure chamber; a bypass hole at the intermediate pressure chamber; a check valve to open and close the bypass hole based on pressure at the intermediate pressure chamber; and a valve assembly provided outside the casing, the valve assembly to couple to a rear side of the check valve, the valve assembly to control opening and closing operations of the check valve such that the check valve opens and closes the communication passage.

Here, the bypass hole includes a plurality of bypass holes along a track of the compression chamber, and the check valve includes a plurality of check valves to independently open and close the plurality of bypass holes, respectively, wherein the plurality of check valves are provided at valve spaces, respectively, the valve spaces formed at the back pressure chamber assembly or the non-orbiting scroll, wherein a differential pressure space is provided at one side of each of the valve spaces with the check valve interposed therebetween, and wherein the plurality of differential pressure spaces communicate with each other via a connection passage provided on the back pressure chamber assembly or the non-orbiting scroll.

An outlet groove is provided on a side of one of the valve spaces to communicate between the bypass hole and the low pressure portion of the casing when the check valve is open, wherein each of a plurality of outlet grooves separately extends to an outer circumferential surface of the non-orbiting scroll or the back pressure chamber assembly.

The outlet grooves independently communicate with the bypass holes, respectively, such that a refrigerant discharged from each of the bypass holes is independently discharged to the low pressure portion of the casing.

A connection pipe extending from the valve assembly communicates with a portion of one of the plurality of differential pressure spaces to generate differential pressure at a surface of the check valve.

The valve assembly comprises: a power supply to couple to an external power source, the power supply includes a mover; a valve portion to couple to the mover of the power supply, and the valve portion is to change a flow direction of a refrigerant; and a connecting portion to couple to the valve portion, and the connection portion is provided through the casing such that a refrigerant, having the changed flow direction based on the valve portion, is provided toward the check valve, and wherein the connecting portion comprises: a first connection pipe to allow a refrigerant of first pressure to flow toward the valve portion; a second connection pipe to allow a refrigerant of second pressure to flow toward the valve portion, wherein the second pressure is lower than the first pressure; and a third connection pipe to couple between the check valve and the valve assembly, and the third connection pipe is selectively coupled to the first connection pipe and the second connection pipe by the valve portion such that the first pressure or the second pressure is supplied to a side of the check valve.

To achieve these and other advantages and in accordance with the purpose of this specification, as embodied and broadly described herein, there is provided a scroll compressor, comprising: a casing; a driving motor within an inner space of the casing; a high/low pressure dividing plate attached to the driving motor to separate the inner space of the casing into a low pressure portion and a high pressure portion; a main frame spaced from the high/low pressure dividing plate; an orbiting scroll at the main frame to perform an orbiting motion based on the driving motor; a non-orbiting scroll to move up and down with respect to the orbiting scroll, and the non-orbiting scroll to form, along with the orbiting scroll, a suction chamber, an intermediate pressure chamber and a discharge chamber; a back pressure plate attached to the non-orbiting scroll, and the back pressure plate having a space portion to communicate with the intermediate pressure chamber and having an open surface to face the high/low pressure dividing plate; and a floating plate movably coupled to the back pressure plate to hermetically seal the space portion and form a back pressure chamber, wherein the non-orbiting scroll includes: a plurality of bypass holes formed from the intermediate pressure chamber to a surface of the non-orbiting scroll facing the back pressure plate, and check valves at the surface of the non-orbiting scroll for opening and closing the bypass holes, respectively, wherein a communication groove is formed on at least one of the surface of the non-orbiting scroll or a surface of the back pressure plate corresponding to the surface of the non-orbiting scroll, wherein a discharge hole to allow communication between the communication groove and the low pressure portion is provided at one of the non-orbiting scroll or the back pressure plate, wherein a first valve assembly is to selectively open and close the discharge hole to selectively communicate between the intermediate pressure chamber and the low pressure portion, wherein the first valve assembly is provided on an outer surface of the non-orbiting scroll or the back pressure plate, and wherein a second valve assembly is provided outside the casing, the second valve assembly is to operate based on an external power source to generate differential pressure in the first valve assembly such that the first valve assembly selectively opens and closes the discharge hole.

Here, an overheat preventing device is provided on the high/low pressure dividing plate, and wherein the overheat preventing device has a portion accommodating a valve, the portion being spaced from the high/low pressure dividing plate.

A scroll compressor according to the present invention may use a less number of components by virtue of installing a check valve in a bypass hole and also simplify a bypass passage for bypassing a refrigerant by virtue of installing a control valve on the bypass hole. This may result in facilitating fabrication of a capacity varying apparatus.

As a control valve is installed on a passage, a refrigerant may be in a state of being already arrived at an outlet of the passage when switching a power operation mode into a saving operation mode, which may allow for fast switching into the saving operation mode.

Also, a position of a control valve may be changed by using a communication pipe, and thus restriction on a specification of the control valve can be relaxed. This may result in enhancing reliability of a capacity varying apparatus.

A bypass hole for bypassing a part of a compressed refrigerant within an intermediate pressure chamber and a check valve for opening and closing the bypass hole can be installed, thereby preventing in advance degradation of efficiency of the compressor due to over-compression.

With an installation of a control valve for varying a capacity at outside of a casing, a degree of freedom to design can be improved. Also, a cheap standardized product can be applied as the control valve, and thus fabricating costs can be reduced.

Any separate terminal for supplying power to a control valve does not have to be provided on a casing, thereby reducing fabricating costs.

A check valve for bypassing a refrigerant of a compression chamber can be installed even between a non-orbiting scroll and a back pressure chamber assembly, which may result in reducing a number of components and reducing fabricating costs accordingly.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having an inner space;

an orbiting member provided in an inner space of the casing, and the orbiting member to perform an orbiting motion;

a non-orbiting member, wherein the orbiting member and the non-orbiting member to form a compression chamber, the compression chamber having a suction chamber, an intermediate pressure chamber and a discharge chamber;

a plurality of bypass holes configured to allow a refrigerant of the intermediate pressure chamber to at least partially pass;

an opening/closing valve assembly configured to open and close the plurality of bypass holes; and a switching valve assembly configured to control the opening/closing valve assembly, the switching valve assembly to be coupled to the opening/closing valve assembly, and the switching valve assembly to be provided outside the casing, wherein a portion of the opening/closing valve assembly is disposed on each separate one of the bypass holes to open and close the corresponding bypass hole, wherein the opening/closing valve assembly includes a plurality of opening/closing valves to independently open and close the plurality of bypass holes, respectively, wherein a back pressure plate is coupled to the non-orbiting member, the back pressure plate has a plurality of valve spaces recessed into a lower surface of the back pressure plate by predetermined depths, and the plurality of opening/closing valves are slidably inserted into the plurality of valve spaces in an axial direction, respectively, wherein a plurality of differential pressure spaces are provided, wherein a corresponding one of the plurality of differential pressure spaces is provided at one side of each of the plurality of valve spaces with the corresponding opening/closing valve interposed therebetween, and wherein the plurality of differential pressure spaces communicate with each other via a connection passage groove provided on the back pressure plate or the non-orbiting member, wherein at least two of the differential pressure spaces communicate with each other by the connection passage groove disposed on the lower surface of the back pressure plate, wherein both ends of the connection passage groove are inclined toward the differential pressure spaces, respectively, and wherein a differential pressure hole is coupled at a portion of the connection passage groove and is connected to a third connection pipe.

2. The scroll compressor of claim 1, wherein the plurality of differential pressure spaces and the plurality of valve spaces are formed with a phase difference of 180°, respectively.

3. The scroll compressor of claim 1, wherein a gasket is provided on an upper surface of the non-orbiting member, wherein the connection passage groove is overlapped with the gasket so as to be sealed.

4. The scroll compressor of claim 1, wherein the differential pressure hole is directly coupled to one of the at least two differential pressure spaces.

5. The scroll compressor of claim 1, wherein the differential pressure hole is coupled to the switching valve assembly through the third connection pipe.

6. The scroll compressor of claim 1, wherein a horizontal sectional area of each of the plurality of differential pressure spaces is greater than a horizontal sectional area of the corresponding bypass hole.

7. The scroll compressor of claim 1, wherein each of a plurality of outlet grooves are independently disposed at each of a plurality of valve spaces, respectively, and wherein the plurality of outlet grooves are coupled with the inner space of the casing, respectively.

8. The scroll compressor of claim 7, wherein the plurality of outlet grooves are disposed from inner circumferential surfaces of plurality of the valve spaces toward an outer circumferential surface of the back pressure plate in a radial direction.

9. A scroll compressor, comprising:

a casing having a hermetic inner space separated into a low pressure portion and a high pressure portion;

an orbiting scroll disposed within an inner space of the casing, and the orbiting scroll to perform an orbiting motion;

a non-orbiting scroll, wherein the orbiting scroll and the non-orbiting scroll to provide a compression chamber, the compression chamber having a suction chamber, an intermediate pressure chamber and a discharge chamber;

a back pressure chamber assembly to couple to the non-orbiting scroll to form a back pressure chamber;

a bypass hole at the intermediate pressure chamber;

a check valve to open and close the bypass hole based on pressure at the intermediate pressure chamber; and a valve assembly provided outside the casing, the valve assembly to couple to a rear side of the check valve, the valve assembly to control opening and closing operations of the check valve such that the check valve opens and closes the bypass hole, wherein the valve assembly comprises:

a power supply includes a mover;

a valve portion to couple to the mover of the power supply, and the valve portion is to change a flow direction of a refrigerant; and a connecting portion to couple to the valve portion, and the connection portion is provided through the casing such that a refrigerant, having the changed flow direction based on the valve portion, is provided toward the check valve, and wherein the connecting portion comprises:

a first connection pipe to allow a refrigerant of first pressure to flow toward the valve portion;

a second connection pipe to allow a refrigerant of second pressure to flow toward the valve portion, wherein the second pressure is lower than the first pressure; and a third connection pipe to couple between the check valve and the valve assembly, and the third connection pipe is selectively coupled to the first connection pipe and the second connection pipe by the valve portion such that the first pressure or the second pressure is supplied to a side of the check valve.

10. The scroll compressor of claim 9, wherein the bypass hole includes a plurality of bypass holes along the compression chamber, and the check valve includes a plurality of check valves to independently open and close the plurality of bypass holes, respectively, wherein the plurality of check valves are provided at a plurality of valve spaces, respectively, the plurality of valve spaces formed at a back pressure plate or the non-orbiting scroll, wherein a differential pressure space is provided at one side of each of the plurality of the valve spaces with the corresponding check valve interposed therebetween, and wherein a plurality of differential pressure spaces communicate with each other via a connection passage groove provided on the back pressure plate or the non-orbiting scroll.

11. The scroll compressor of claim 10, comprising a plurality of outlet grooves, wherein one of the plurality of outlet grooves is at a side of one of the plurality of valve spaces to communicate between the corresponding bypass hole and the low pressure portion of the casing when the corresponding check valve is open, wherein each of the plurality of outlet grooves separately extends to an outer circumferential surface of the non-orbiting scroll or the back pressure plate.

12. The scroll compressor of claim 11, wherein the plurality of outlet grooves independently communicate with the plurality of bypass holes, respectively, such that a refrigerant discharged from each of the plurality of bypass holes is independently discharged to the low pressure portion of the casing.

13. The scroll compressor of claim 10, wherein the third connection pipe extending from the valve assembly communicates with a portion of one of the plurality of differential pressure spaces to generate differential pressure at a surface of the corresponding check valve.

14. A scroll compressor, comprising:

a casing having an inner space;

an orbiting member provided in the inner space of the casing, and the orbiting member to perform an orbiting motion;

a non-orbiting member, wherein the orbiting member and the non-orbiting member to form a compression chamber, the compression chamber having a suction chamber, an intermediate pressure chamber and a discharge chamber;

a plurality of bypass holes configured to allow a refrigerant of the intermediate pressure chamber to at least partially pass;

an opening/closing valve assembly configured to open and close the plurality of bypass holes; and a switching valve assembly configured to control the opening/closing valve assembly, the switching valve assembly to be coupled to the opening/closing valve assembly, and the switching valve assembly to be provided outside the casing, wherein a portion of the opening/closing valve assembly is disposed on each separate one of the bypass holes to open and close the corresponding bypass hole, wherein the opening/closing valve assembly includes a plurality of opening/closing valves to independently open and close the plurality of bypass holes, respectively, wherein a back pressure plate is coupled to the non-orbiting member, the back pressure plate has a plurality of valve spaces recessed into a lower surface of the back pressure plate by predetermined depths, and the plurality of opening/closing valves are slidably inserted into the plurality of valve spaces in an axial direction, respectively, wherein a plurality of differential pressure spaces are provided, wherein a corresponding one of the plurality of differential pressure spaces is provided at one side of each of the plurality of valve spaces with the corresponding opening/closing valve interposed therebetween, and wherein the plurality of differential pressure spaces communicate with each other via a connection passage groove provided on the back pressure plate or the non-orbiting member, wherein at least two of the differential pressure spaces communicate with each other by the connection passage groove disposed on the lower surface of the back pressure plate, wherein both ends of the connection passage groove are inclined toward the differential pressure spaces, respectively, and wherein a gasket is provided on an upper surface of the non-orbiting member, wherein the connection passage groove is overlapped with the gasket so as to be sealed.

15. The scroll compressor of claim 14, wherein the plurality of differential pressure spaces and the plurality of valve spaces are formed with a phase difference of 1800, respectively.

16. The scroll compressor of claim 14, wherein a horizontal sectional area of each of the plurality of differential pressure spaces is greater than a horizontal sectional area of the corresponding bypass hole.

17. The scroll compressor of claim 14, wherein each of the plurality of outlet grooves are independently disposed at each of the plurality of the valve spaces, respectively, wherein the plurality of outlet grooves are coupled with the inner space of the casing, respectively.

18. The scroll compressor of claim 14, wherein the plurality of outlet grooves are independently disposed at the plurality of valve spaces, respectively, wherein the outlet grooves are coupled with the inner space of the casing, respectively.

* * * * *